US009733585B2

(12) United States Patent
Fujisaki et al.

(10) Patent No.: US 9,733,585 B2
(45) **Date of Patent: *Aug. 15, 2017**

(54) TONER FOR ELECTROSTATIC CHARGE IMAGE DEVELOPMENT

(71) Applicant: Konica Minolta, Inc., Tokyo (JP)

(72) Inventors: Natsuko Fujisaki, Hino (JP); Makoto Nomiya, Tokyo (JP); Tomomi Oshiba, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/184,457

(22) Filed: Jun. 16, 2016

(65) Prior Publication Data

US 2017/0023873 A1 Jan. 26, 2017

(30) Foreign Application Priority Data

Jul. 24, 2015 (JP) ..... 2015-147215

(51) Int. Cl.

| | |
|---|---|
| ***G03G 9/087*** | (2006.01) |
| ***G03G 9/093*** | (2006.01) |
| ***G03G 9/08*** | (2006.01) |

(52) U.S. Cl.

CPC ..... *G03G 9/08726* (2013.01); *G03G 9/0806* (2013.01); *G03G 9/08711* (2013.01); *G03G 9/08755* (2013.01); *G03G 9/08797* (2013.01); *G03G 9/093* (2013.01)

(58) Field of Classification Search

CPC ..... G03G 9/08784; G03G 9/08786; G03G 9/08788

See application file for complete search history.

(56) References Cited

U.S. PATENT DOCUMENTS

| | | | | |
|---|---|---|---|---|
| 9,529,293 | B2 * | 12/2016 | Fujisaki | G03G 9/08755 |
| 2006/0057483 | A1 | 3/2006 | Yanase | |
| 2008/0025754 | A1 | 1/2008 | Ishiyama | |

FOREIGN PATENT DOCUMENTS

| | | | |
|---|---|---|---|
| JP | 2006106727 | A | 4/2006 |
| JP | 2008033057 | A | 2/2008 |
| JP | 2013257415 | A | 12/2013 |

* cited by examiner

*Primary Examiner* — Hoa V Le
(74) *Attorney, Agent, or Firm* — Lucas & Mercanti, LLP

(57) ABSTRACT

The present invention relates to a toner for electrostatic charge image development containing toner base particles containing a binder resin containing a vinyl resin as a main component and a crystalline resin, and a release agent, comprising a structure body in which the crystalline resin is in contact with the release agent, and the crystalline resin having a lamellar crystal structure that is not in contact with the release agent, in a cross section of the toner base particles. According to the present invention, a toner for electrostatic charge image development having good low-temperature fixability, excellent post-fixing separability, document storability, and high-speed fixability, and small environmental dependence of charge amount can be provided.

9 Claims, 2 Drawing Sheets

TONER FOR ELECTROSTATIC CHARGE IMAGE DEVELOPMENT

CROSS-REFERENCE TO RELATED APPLICATION

This application is based on Japanese Patent Application No. 2015-147215 filed on Jul. 24, 2015, the contents of which are incorporated herein by reference.

BACKGROUND

1. Technical Field

The present invention relates to a toner for electrostatic charge image development.

2. Description of Related Art

In recent years, in progress of coloration and speed-up of a copy machine, an environmentally friendly toner for electrostatic charge image development (hereinafter, also simply referred to as "toner") with low cost and high image quality is required in the electrophotographic field. To satisfy this requirement, conversion from a conventional pulverized toner to a chemical toner is progressing. Various methods for manufacturing a chemical toner have been studied, and the products by some methods of them have been launched. However, further cost reduction of a copy machine and a printer with toner is required, and also, requirement on toner characteristics for obtaining high image quality becomes higher.

In addition, in recent years, the transition from analogue to digital progresses in the printer and copy machine, improvement in printing speed and reduction of used power consumption, as well as high resolution, are strongly required. As a countermeasure for it, a demand for lowering temperature of the fixing temperature of toner is large. Conventionally, many studies have been done for low temperature fixing of toner, and the representative study includes those using a crystalline resin.

For example, in a toner containing a crystalline resin, a technique for existing a structure body having a structure in which the crystalline resin is in contact with a release agent, a release agent alone that is not in contact with the crystalline resin, and the crystalline resin alone that is not in contact with the release agent in the toner is suggested (JP-A-2008-33057 (corresponding to US 2008/025754 A1)). In addition, a technique for existing a crystalline resin having a lamellar crystal structure in a toner surface layer (toner base particle surface) is suggested (JP-A-2006-106727). Furthermore, in a toner containing a crystalline resin having a fibrous crystal structure, a technique for controlling a domain diameter of the fibrous crystal structure is suggested (JP-A-2013-257415).

SUMMARY

As the techniques described in JP-A-2008-33057 (corresponding to US 2008/025754 A1), JP-A-2006-106727 and JP-A-2013-257415 A1, low-temperature fixability can be improved by controlling the crystal structure and domain diameter of the crystalline resin contained in a toner. However, in the toner described in JP-A-2008-33057 (corresponding to US 2008/025754 A1), a release agent hardly oozes out to the image surface due to the structure body, thus post-fixing separability is not sufficient. Moreover, in the toner described in JP-A-2006-106727, a crystalline resin having a lamellar crystal structure is present on the toner surface, thus oozing out of a release agent is suppressed as described above, and good post-fixing separability is not obtained. Furthermore, in the toner described in JP-A-2013-257415, a crystalline resin having a fibrous crystal structure has a small domain diameter, thus is excessively compatibilized with an amorphous resin constituting a binder resin, and causes plasticization of the binder resin. Accordingly, deterioration of document storability is a problem.

As described above, the toners suggested in JP-A-2008-33057 (corresponding to US 2008/025754 A1), JP-A-2006-106727 and JP-A-2013-257415 described above, there have been problems that both post-fixing separability, document storability and the like cannot be satisfied while maintaining low-temperature fixability. Further, in recent years, based on the background that a high functional toner is required, a technique capable of increasing fixable speed (process speed), i.e. high-speed fixability, and also improving environmental dependence of charge amount is also required, so as to deal with the requirement of improvement in image quality.

Thus, an object of the present invention is to provide a toner for electrostatic charge image development having good low-temperature fixability, excellent post-fixing separability, document storability, and high-speed fixability, and small environmental dependence of charge amount.

The present inventors have conducted intensive studies in consideration of the above problem. As a result, they have found out that the above problem is solved by a toner for electrostatic charge image development containing a structure body in which a crystalline resin is in contact with a release agent, and the crystalline resin having a lamellar crystal structure that is not in contact with the release agent, in the cross section of the toner base particles containing a vinyl resin as a main component, thereby completing the present invention.

BRIEF DESCRIPTION OF THE DRAWINGS

In FIG. 1, symbol 4 and symbol 5 represent a crystalline resin having a lamellar crystal structure that is not in contact with a release agent and a vinyl resin, respectively;

In FIG. 2, symbol 10, symbol 11 and symbol 12 represent a hybrid crystalline polyester resin, a vinyl resin segment and a crystalline polyester resin segment, respectively; In FIG. 3, symbol 1, symbol 2, symbol 3, symbol 4 and symbol 5 represent a crystalline resin, a release agent, a structure body, a crystalline resin having a lamellar crystal structure that is not in contact with a release agent and a vinyl resin, respectively.

DETAILED DESCRIPTION

Hereinafter, embodiments for carrying out the present invention will be described in detail. Here, the present invention is not limited only to the following embodiments.

In addition, as used herein, the "from X to Y" indicating the range means "X or more and Y or less", including X and Y. In addition, unless otherwise stated, the operations and the measurements of physical properties are conducted under the conditions of room temperature (25° C.)/relative humidity of 40 to 50% RH.

An embodiment of the present invention is a toner for electrostatic charge image development containing toner base particles containing a binder resin containing a vinyl resin as a main component and a crystalline resin, and a release agent, comprising a structure body in which the crystalline resin is in contact with the release agent (hereinafter, also simply referred to as "structure body"), and the crystalline resin having a lamellar crystal structure that is not in contact with the release agent (hereinafter, also simply referred to as "lamellar crystal structure"), in the cross section of the toner base particles.

According to the present invention, a toner for electrostatic charge image development having good low-temperature fixability, excellent post-fixing separability, document storability, and high-speed fixability, and small environmental dependence of charge amount can be provided.

Figure 1:
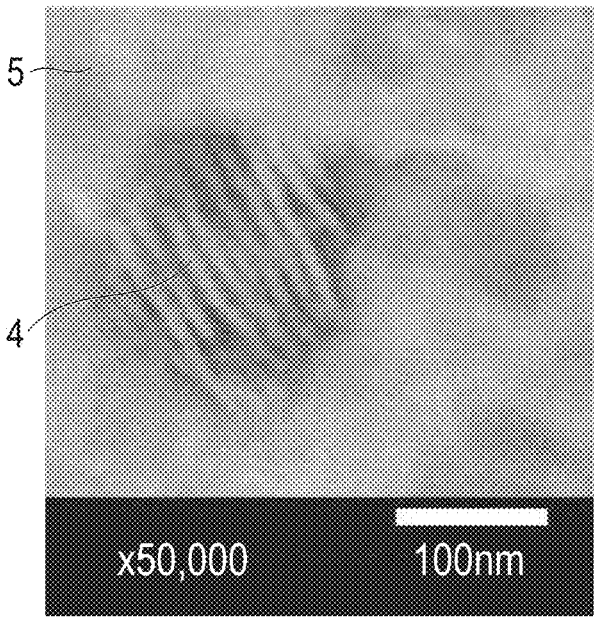
FIG. 1 is a photograph obtained by subjecting the cross section of the toner base particle by an embodiment of the present invention to ruthenium staining, then observing it by a secondary electron image using a TEM (transmission electron microscope).

Here, the "lamellar crystal structure" refers to a layer structure generated by crystallization by folding of the molecular chain of a crystalline resin, as shown in FIG. 1. The detailed description according to the structure will be described later. The "toner for electrostatic charge image development" is herein sometimes simply referred to as "toner".

The toner having the above constitution exhibits excellent effects of having excellent post-fixing separability, document storability, and high-speed fixability, and small environmental dependence of charge amount (excellent in chargeability).

As the conventional techniques described above, it is possible to improve low-temperature fixability by controlling the crystal structure and domain diameter of the crystalline resin constituting toner base particles. However, the present inventors have found a problem that all of the characteristics such as post-fixing separability, document storability, high-speed fixability and chargeability cannot be improved in a good balance, even by the conventional techniques described above. The present inventors have conducted intensive studies against the problem, and consequently found that the toner having the constitution according to the present invention can improve not only low-temperature fixability, but also the characteristics such as post-fixing separability. Regarding the reason why the above effects are obtained by the toner of the present invention, expression mechanism and action mechanism have not been clarified, but are assumed as follows.

The toner base particles constituting the toner according to the present invention contains a structure body in which a release agent is not in contact with a crystalline resin. Namely, in the structure body, the crystalline resin and the release agent have a crystal structure, and they are present in contact with each other. Accordingly, it is considered that the crystalline resin and the release agent suppress excessive compatibilization with other resin constituting the toner base particles (specifically, vinyl resin) each other. In addition, the crystalline resin having a lamellar crystal structure is not completely melted, but melted keeping the layer structure when heated in a very short time for heat fixing. Therefore, the crystalline resin having a lamellar crystal structure can reduce the rate of mutually dissolving with the vinyl resin during heat fixing, as compared to, for example, a crystalline resin dispersed in minute fibers (finely dispersed). Therefore, as a result of being capable of suppressing excessive compatibilization of the crystalline resin with the vinyl resin during heat fixing, it is assumed that deterioration of document storability caused by toner plasticization can be effectively suppressed.

Also, the toner base particles constituting the toner according to the present invention contains a structure body in which a release agent is in contact with a crystalline resin, as described above, thus, due to an interaction between the release agent and the crystalline resin, oozing out of the release agent to the image surface tends to be suppressed. Such suppression of oozing out of the release agent tends to deteriorate post-fixing separability. On the other hand, the toner according to the present invention further contains a crystalline resin that is not in contact with a release agent, and has a lamellar crystal structure. Thus, deformation of the toner base particles is promoted, using a characteristic that the lamellar crystal structure is easily deformed (likely to be crushed) during heat fixing. As a result, the toner base particles are instantaneously crushed, during heat fixing, and the release agent forcibly oozes out to the image surface accompanied by deformation of the toner base particles, thus a toner also excellent in post-fixing separability can be obtained.

Further, the toner base particles constituting the toner according to the present invention contains the crystalline resin having a lamellar crystal structure as described above, thus, at the moment when heat is applied to the toner during heat fixing, the lamellar crystal structure melts while keeping its shape (layer structure) before melting, and then can be instantaneously crushed by a fixing nip. Accordingly, the effect of improving process speed is exhibited, and high-speed fixability can be also improved.

Furthermore, the toner according to the present invention contains a vinyl resin as a main component, as an amorphous resin constituting the toner base particles. Accordingly, phase separation of the crystalline resin and the vinyl resin is likely to progress, in the toner base particles. While the structure body has an action of suppressing formation of a crystal structure of the crystalline resin, the crystalline resin is likely to form a crystal structure, by containing the vinyl resin in the toner base particles. As a result, the crystalline resin can contribute to the characteristics such as low-temperature fixability as described above. In addition, the toner base particles contain a vinyl resin as a main component, so that environmental dependence of charge amount can be reduced. The reason is not known, but is considered as follows. It is considered that environmental dependence of chargeability is dependent on the ratio of oxygen atom contained in the binder resin, and hydrophilicity is enhanced when the ratio of oxygen atom is high, and chargeability of the toner is lowered. Accordingly, as compared to the case where a polyester resin or the like with a high ratio of oxygen atom is contained as an amorphous resin, the vinyl resin is hardly affected by water, thus it is assumed that change of the charge amount is small even when environment changes. When environmental dependence of charge amount is small, an effect of hardly changing an image quality is obtained, even in the case of outputting the image in different environments, thus it becomes possible to deal with the improvement in image quality that is recently increasingly required.

The above mechanism is described by estimation, and the present invention is not restricted by the above mechanism at all.

Hereinafter, the toner for electrostatic charge image development of the present invention will be described in detail. The "toner" according to the present invention contains "toner base particles" as described above. The "toner base particles" is called as "toner particles" after addition of external additive. Moreover, the "toner" refers to an aggregate of the "toner particles".

[Toner Base Particles]

The toner base particles according to the present invention contain a binder resin containing a vinyl resin as a main component and a crystalline resin. In addition, the toner base particles contain a release agent, and may contain other toner constituents such as a colorant, a magnetic powder, and a charge control agent, as necessary.

<Binder Resin (Vinyl Resin and Crystalline Resin)>

The toner base particles according to the present invention contain a binder resin containing a vinyl resin as a main component and a crystalline resin.

<<Vinyl Resin>>

The vinyl resin refers to a resin obtained by polymerization at least using vinyl monomers. Specific examples of the vinyl resin include acrylic resins, styrene-acrylic copolymer resins, and the like.

Among them, the vinyl resin is preferably a styrene-acrylic copolymer resin formed using styrene monomers and (meth)acrylic ester monomers. The vinyl resin may be used singly or in combination of two or more kinds.

In the toner of the present invention, the vinyl resin is a main component of the binder resins contained in the toner base particles. Here, the main component means a resin with the highest content ratio among binder resins contained in the toner base particles. When the vinyl resin is a main component, particularly when the crystalline resin is a crystalline polyester resin, the vinyl resin and the crystalline polyester resin are hardly compatible with each other, and the crystalline polyester resin is likely to be present while keeping the crystal structure. Particularly when the vinyl resin is a main component, the lamellar crystal structure is likely to be present. Accordingly, it is possible to provide a toner having good low-temperature fixability and excellent post-fixing separability and high-speed fixability. Also, when the vinyl resin is a main component, it is possible to provide a toner having a small environmental dependence of charge amount, namely having good chargeability.

The vinyl resin is a resin with the highest content ratio among binder resins contained in the toner, as described above, and the content is preferably 50 to 99.9% by mass, more preferably 50 to 99% by mass, further more preferably 50 to 97% by mass, further more preferably 60 to 95% by mass, particularly preferably 70 to 95% by mass, and most preferably 75 to 95% by mass, relative to the total binder resin in the toner. When the content of the vinyl resin is 50% by mass or more, effects of suppression of compatibilization with the crystalline resin, and improvement in chargeability are increased, and in a content of 60% by mass or more, 70% by mass or more, and further 75% by mass or more, the effects are further likely to increase. Also, as the vinyl resin is increased, the vinyl resin and the crystalline resin are likely to form a continuous phase (matrix) and a dispersed phase (domain), respectively, in the toner base particles. As a result, the crystalline resin is suppressed to expose in the toner base particles, and contributes to the effect of improving fixability. On the other hand, the content is preferably 99.9% by mass or less, more preferably 99% by mass or less, further more preferably 97% by mass or less, and particularly preferably 95% by mass or less, from the viewpoint of improving low-temperature fixability.

As the vinyl monomer forming the vinyl resin, one or more kinds selected from the following can be used.

(1) Styrene Monomers

Styrene, o-methylstyrene, m-methylstyrene, p-methylstyrene, α-methylstyrene, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene, p-n-dodecylstyrene, derivatives thereof, etc.

(2) (Meth)Acrylic Ester Monomers

Methyl (meth)acrylate, ethyl (meth)acrylate, n-butyl (meth)acrylate, isopropyl (meth)acrylate, isobutyl (meth) acrylate, t-butyl (meth)acrylate, n-octyl (meth)acrylate, 2-ethylhexyl (meth)acrylate, stearyl (meth)acrylate, lauryl (meth)acrylate, phenyl (meth)acrylate, diethylaminoethyl (meth)acrylate, dimethylaminoethyl (meth)acrylate, derivatives thereof, etc.

(3) Vinyl Esters

Vinyl propionate, vinyl acetate, vinyl benzoate, etc.

(4) Vinyl Ethers

Vinyl methyl ether, vinyl ethyl ether, etc.

(5) Vinyl Ketones

Vinyl methyl ketone, vinyl ethyl ketone, vinyl hexyl ketone, etc.

(6) N-Vinyl Compounds

N-Vinylcarbazole, N-vinylindole, N-vinylpyrrolidone, etc.

(7) Others

Vinyl compounds such as vinylnaphthalene and vinylpyridine, acrylonitrile, methacrylonitrile, acrylic or methacrylic acid derivatives such as acrylamide, etc.

Also, as the vinyl monomer, it is preferred to use, for example, a monomer having an ionic dissociation group such as a carboxyl group, a sulfonate group or a phosphate group. Specific examples include the following.

The monomer having a carboxyl group includes acrylic acid, methacrylic acid, maleic acid, itaconic acid, cinnamic acid, fumaric acid, maleic monoalkyl ester, itaconic monoalkyl ester, and the like. In addition, the monomer having a sulfonate group includes styrene sulfonic acid, allylsulfosuccinic acid, 2-acrylamido-2-methylpropanesulfonic acid, and the like. Furthermore, the monomer having a phosphate group includes acid phosphoxyethyl methacrylate, and the like.

Moreover, it is also possible to form a vinyl resin having a crosslinked structure, by using polyfunctional vinyls as the vinyl monomer. The polyfunctional vinyls include divinylbenzene, ethylene glycol dimethacrylate, ethylene glycol diacrylate, diethylene glycol dimethacrylate, diethylene glycol diacrylate, triethylene glycol dimethacrylate, triethylene glycol diacrylate, neopentyl glycol dimethacrylate, neopentyl glycol diacrylate, and the like.

The method for manufacturing a vinyl resin is not particularly limited, and includes methods for carrying out polymerization by a known polymerization method such as bulk polymerization, solution polymerization, emulsion polymerization, mini-emulsion or dispersion polymerization, using an arbitrary polymerization initiator such as a peroxide, a persulfide or an azo compound, usually used in polymerization of the above monomers. Also, for the purpose of adjusting the molecular weight, a generally used chain transfer agent can be used. The chain transfer agent is not particularly limited, and examples include alkyl mercaptan, mercapto fatty acid ester, and the like.

The vinyl resin is preferably an amorphous resin having a glass transition point (Tg) of 25 to 60° C., and is more preferably an amorphous resin having a glass transition point (Tg) of 35 to 55° C. The glass transition point (Tg) of the resin is measured using, for example, "DIAMOND DSC" (manufactured by Perkin Elmer, Co., Ltd). As a measurement procedure of the glass transition point (Tg) herein, the following method was adopted. First, 3.0 mg of a measurement sample (resin) was sealed in an aluminum pan and set in a sample holder of "DIAMOND DSC". An empty aluminum pan was used as a reference. A DSC curve was obtained under measurement conditions (temperature increase and cooling conditions) which underwent, in the following order, a first temperature increase process in which the temperature was raised from 0° C. to 200° C. at a temperature increase rate of 10° C./min, a cooling process in which the temperature was cooled from 200° C. to 0° C. at a cooling rate of 10° C./min, and a second temperature increase process in which the temperature was raised from 0° C. to 200° C. at a temperature increase rate of 10° C./min. On the basis of the DSC curve obtained by this measurement, an extension line from the base-line prior to the rise of the first endothermic peak in the second temperature increase process and a tangent line exhibiting the maximum slope between the initial rise and the peak of the first peak were drawn, and the intersection of both lines was defined as the glass transition point (Tg).

In addition, the vinyl resin preferably has a molecular weight of 10,000 to 100,000, in terms of weight average molecular weight (Mw) as measured by gel permeation chromatography (GPC).

The molecular weight (weight average molecular weight and number average molecular weight) of the resin by GPC herein is a value measured as described below. Specifically, using an apparatus "HLC-8120GPC" (manufactured by TOSOH CORPORATION) and a column "TSK guard column+TSK gel Super HZ-M3 series" (manufactured by TOSOH CORPORATION), tetrahydrofuran (THF) is added as a carrier solvent at a flow rate of 0.2 mL/min while maintaining the column temperature at 40° C. A measurement sample (resin) is dissolved in tetrahydrofuran so as to have a concentration of 1 mg/ml under dissolving conditions including 5-minute treatment using an ultrasonic disperser at room temperature, and subsequently treated with a membrane filter with a pore size of 0.2 μm to obtain a sample solution. 10 μL of this sample solution is injected to the device together with the carrier solvent, and the detection is made using a refractive index detector (RI detector). The molecular weight distribution of the measurement sample is calculated using a calibration curve determined by using mono-dispersed polystyrene reference particles. Ten polystyrene reference samples are used for determining a calibration curve.

<<Crystalline Resin>>

The crystalline resin is not particularly limited as long as it is a resin having crystallinity, and a crystalline resin conventionally known in the art can be used. Specific examples thereof include crystalline polyester resins, crystalline polyurethane resins, crystalline polyurea resins, crystalline polyamide resins, crystalline polyether resins, and the like. The crystalline resin can be used singly or in combination of two or more kinds.

Among them, the crystalline resin is preferably a crystalline polyester resin. Here, the "crystalline polyester resin" refers to a resin that, among known polyester resins obtained by a polycondensation reaction of divalent or more carboxylic acid (polycarboxylic acid) and a derivative thereof, and divalent or more alcohol (polyhydric alcohol) and a derivative thereof, has no step-wise endothermic change in measurement of differential scanning calorimetry (DSC) but has a clear endothermic peak. The clear endothermic peak specifically means a peak that has 15° C. or less half-width of the endothermic peak when measured at 10° C./min of the temperature increase rate in measurement of differential scanning calorimetry (DSC). Examples of the polycarboxylic acid derivative include alkyl esters, acid anhydrides and acid chlorides of a polycarboxylic acid, and examples of the polyhydric alcohol derivative include ester compounds of a polyhydric alcohol and hydroxycarboxylic acids.

The polycarboxylic acid is a compound containing two or more carboxyl groups in one molecule. Among them, divalent carboxylic acid is a compound containing two carboxyl groups in one molecule, and examples include saturated aliphatic dicarboxylic acids such as oxalic acid, malonic acid, succinic acid, adipic acid, pimelic acid, sebacic acid, azelaic acid, n-dodecyl succinic acid, 1,9-nonanedicarboxylic acid, 1,10-decanedicarboxylic acid (dodecanedioic acid), 1,11-undecanedicarboxylic acid, 1,12-dodecanedicarboxylic acid (tetradecanedioic acid), 1,13-tridecanedicarboxylic acid, and 1,14-tetradecanedicarboxylic acid; alicyclic dicarboxylic acids such as cyclohexanedicarboxylic acid; unsaturated aliphatic dicarboxylic acids such as maleic acid, fumaric acid, citraconic acid, and itaconic acid; aromatic dicarboxylic acids such as phthalic acid, isophthalic acid, and terephthalic acid; and the like. In addition, examples of polycarboxylic acid other than divalent carboxylic acid include trivalent or more polycarboxylic acids such as trimellitic acid and pyromellitic acid. In addition, the derivative of polycarboxylic acid includes anhydrides of these carboxylic acids; alkyl esters having 1 to 3 carbon atoms of these carboxylic acids; and the like. These compounds may be used singly, or may be used in combination of two or more kinds.

The polyhydric alcohol is a compound containing two or more hydroxyl groups in one molecule. Among them, divalent polyol (diol) is a compound containing two hydroxy groups in one molecule, and examples include aliphatic diols such as ethylene glycol, 1,2-propanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol, neopentyl glycol and 1,4-butenediol. In addition, examples of polyol other than divalent polyol include trivalent or more polyhydric alcohols such as glycerol, pentaerythritol, trimethylolpropane and sorbitol; and the like. These compounds may be used singly, or may be used in combination of two or more kinds.

In addition, the crystalline polyester resin may partly have a branch, crosslinking or the like, depending on the selection of the valence of the polycarboxylic acid and the valence of the polyhydric alcohol, and the like.

The method for forming the crystalline polyester resin using monomers is not particularly limited, and the resin can be formed by a polycondensation (esterification) of the polycarboxylic acid and the polyhydric alcohol, by using a known esterification catalyst.

(Hybrid Crystalline Resin)

The crystalline resin according to the present invention preferably contains a crystalline resin having a hybrid structure in order to have a lamellar crystal structure in the toner base particles. The crystalline resin having a hybrid structure (hereinafter, also referred to as "hybrid crystalline resin" or "hybrid resin", and a crystalline resin without having a plurality of segments is also simply referred to as "non-hybrid crystalline resin") is a resin in which a crystalline resin segment and a resin segment other than a crystalline resin are chemically bonded. The crystalline resin segment refers to a part derived from a crystalline resin, and the resin segment other than a crystalline resin refers to a part derived from a resin other than a crystalline resin. Examples of the resin other than a crystalline resin include vinyl resins such as styrene-acrylic resins, urethane resins, urea resins, polyester resins not having crystallinity, and the like. The resin segment other than a crystalline resin may be used singly, or may be used in combination of two or more kinds.

Among them, the crystalline resin is preferably a hybrid crystalline resin formed by chemically bonding a crystalline polyester resin segment as the crystalline resin segment and an amorphous resin segment other than a polyester resin as the resin segment other than a crystalline resin. In such embodiment, an effect of improving low-temperature fixability by the crystalline resin is likely to be obtained.

At this time, the amorphous resin segment is preferably a vinyl resin segment. Specifically, the crystalline resin is preferably a crystalline resin formed by chemically bonding a crystalline polyester resin segment and a vinyl resin segment. Further, these segments are preferably bonded via a bireactive monomer. Furthermore, the crystalline resin is preferably a graft copolymer having a vinyl resin segment as a backbone, and a crystalline polyester resin as a branch, from the viewpoint of easily forming a lamellar crystal structure.

As described above, the crystalline resin contains a hybrid resin containing the vinyl resin segment, so that the thickness by folding of the molecular chain of a lamellar crystal structure can be increased to some extent (namely, crystallinity can be increased), the domain diameter of the lamellar crystal structure described later and the like are easily controlled within a predetermined range. This is thought to be attributable to that, because a vinyl resin segment introduced into the hybrid crystalline resin has high affinity with the vinyl resin contained in the binder resin, the hybrid crystalline resin has affinity to the vinyl resin (easily fixed), and consequently, arrangement of the molecular chain of the crystalline resin becomes easy to be aligned in the same direction.

Vinyl Resin Segment

The vinyl resin segment constituting the hybrid crystalline resin is constituted by a resin obtained by polymerizing vinyl monomers. Here, as the vinyl monomer, the same compounds as the monomer constituting a vinyl resin described above can be used, thus the detailed explanation is omitted. The content (hybridization rate ("HB rate" described in the examples described later; mass ratio) of the amorphous resin segment other than a polyester resin (vinyl resin segment) in the hybrid crystalline resin is not particularly limited, but the hybridization rate of the hybrid crystalline resin is more preferably in the range of 5 to 30% by mass, further preferably in the range of 5 to 20% by mass, and particularly preferably in the range of 5 to 10% by mass. When the hybridization rate in the hybrid crystalline resin is in this range, there is an advantage that a lamellar crystal structure that is a characteristic constitution of the toner according to the present invention is easily formed. Crystalline resin segment portions originally gather in the hybrid crystalline resin, as compared to in the non-hybrid crystalline resin, thus the crystalline resin segment portions are easily uniformly arranged in crystallization, and the crystal structure easily appears in a lamellar form. Among the hybrid crystalline resins, one having a comb-shaped hybrid structure shown in FIG. 2 described later is likely to have a particularly fine crystalline arrangement, and is likely to form a lamellar crystal structure.

Crystalline Polyester Resin Segment

The crystalline polyester resin segment constituting a hybrid resin is constituted by a crystalline polyester resin manufactured by a polycondensation reaction of a polycarboxylic acid and a polyhydric alcohol, in the presence of a catalyst. Here, specific kinds of the polycarboxylic acid and the polyhydric alcohol are as described above, thus the detailed explanation is omitted.

Bireactive Monomer

The "bireactive monomer" refers to a monomer combining a crystalline polyester resin segment and a vinyl resin segment, and is a monomer having both a group selected from a hydroxy group, a carboxyl group, an epoxy group, a primary amino group and a secondary amino group that forms the crystalline polyester polymerization segment, and an ethylenically unsaturated group that forms the vinyl resin segment, in the molecule. The bireactive monomer is preferably a monomer having a hydroxy group or carboxyl group, and an ethylenically unsaturated group. The bireactive monomer is further preferably a monomer having a carboxyl group, and an ethylenically unsaturated group. Specifically, the bireactive monomer is preferably a vinyl-based carboxylic acid.

Specific examples of the bireactive monomer include acrylic acid, methacrylic acid, fumaric acid, maleic acid and the like, and may also be a hydroxylalkyl (carbon atom number of 1 to 3) ester thereof. From the viewpoint of reactivity, acrylic acid, methacrylic acid or fumaric acid is preferable. The crystalline polyester resin segment and the vinyl resin segment can be combined via these bireactive monomers.

The use amount of the bireactive monomer is, from the viewpoint of improving low-temperature fixability, high-temperature offset resistance and durability of the toner, preferably 1 to 15 parts by mass and more preferably 4 to 13 parts by mass, relative to 100 parts by mass of the total amount of the vinyl monomers constituting the vinyl resin segment.

Method for Manufacturing Hybrid Crystalline Resin

An existing general scheme can be used as a method for manufacturing a hybrid crystalline resin. A representative method includes the following three methods.

(1) A method for forming a hybrid crystalline resin by previously polymerizing a crystalline polyester resin segment, reacting a bireactive monomer with the crystalline polyester resin segment, and further reacting a vinyl monomer for forming a vinyl resin segment with it;

(2) A method for forming a hybrid crystalline resin by previously polymerizing a vinyl resin segment, reacting a bireactive monomer with the vinyl resin segment, and further reacting a polycarboxylic acid and a polyhydric alcohol for forming a crystalline polyester resin segment with it; and (3) A method for forming a hybrid crystalline resin by combining a crystalline polyester resin segment and a vinyl resin segment by each previously polymerizing both segments, and reacting a bireactive monomer with these resin segments.

In the present invention, any method among the above manufacturing methods can be used, but a method of the above item (2) is preferred. Specifically, it is preferred to mix a polycarboxylic acid and a polyhydric alcohol for forming a crystalline polyester resin segment, and a vinyl monomer for forming a vinyl resin segment and a bireactive monomer, add a polymerization initiator to form a vinyl resin segment by addition-polymerizing the vinyl monomer and the bireactive monomer, then add an esterification catalyst to perform a polycondensation reaction.

Here, as a catalyst for synthesizing a crystalline polyester resin segment, various conventionally known catalysts can be used. Also, the esterification catalyst includes tin compounds such as dibutyltin oxide and tin(II) 2-ethylhexanoate, titanium alkoxides such as tetranormalbutyl titanate, tetraisopropyl titanate, tetramethyl titanate and tetrastearyl titanate, and the like, and the esterification cocatalyst includes gallic acid and the like.

The crystalline resin (hereinafter, including hybrid crystalline resins) has a melting point (Tm) of preferably 55 to 90° C., and more preferably 70 to 88° C. When melting point of the crystalline resin is in the range of 55 to 90° C., sufficient low-temperature fixability and excellent hot-offset resistance are obtained. Here, the melting point of the crystalline resin can be controlled by resin composition. The melting point of the crystalline resin can be measured by a differential scanning calorimeter (DSC).

The melting point (Tm) of the resin is measured using, for example, "DIAMOND DSC" (manufactured by Perkin Elmer, Co., Ltd). As a measurement procedure of the melting point (Tm) herein, the following method was adopted. First, 3.0 mg of a measurement sample (resin) was sealed in an aluminum pan, and this was set in a sample holder of "DIAMOND DSC". An empty aluminum pan was used as a reference. A DSC curve was obtained under measurement conditions (temperature increase and cooling conditions) which underwent, in the following order, a first temperature increase process in which the temperature was raised from 0° C. to 200° C. at a temperature increase rate of 10° C./min, a cooling process in which the temperature was cooled from 200° C. to 0° C. at a cooling rate of 10° C./min, and a second temperature increase process in which the temperature was raised from 0° C. to 200° C. at a temperature increase rate of 10° C./min. On the basis of the DSC curve obtained by this measurement, the peak top temperature of an endothermic peak (endothermic peak with a half width of 15° C. or lower) derived from the crystalline resin in the second temperature increase process was defined as the melting point (Tm).

The crystalline resin preferably has a weight average molecular weight (Mw) measured by gel permeation chromatography (GPC) in the range of 5,000 to 50,000, and preferably has a number average molecular weight (Mn) in the range of 1,500 to 25,000.

The content of the crystalline resin is preferably 0.1 to 50% by mass, more preferably 1 to 50% by mass, further more preferably 3 to 50% by mass, further more preferably 5 to 40% by mass, particularly preferably 5 to 30% by mass, and most preferably 5 to 25% by mass, relative to the total binder resin in the toner. When the content of the crystalline resin is 0.1% by mass or more, an effect of low-temperature fixability can be further exhibited by proper compatibilization with the vinyl resin. Furthermore, in a content of 1% by mass or more, further 3% by mass or more, and further 5% by mass or more, the effect is further likely to increase. On the other hand, the content of the crystalline resin is preferably 50% by mass or less, more preferably 40% by mass or less, further more preferably 30% by mass or less, and particularly preferably 25% by mass or less, from the viewpoint of improvement in heat resistant storage property of the toner and suppression of offset in the high-temperature fixing area by properly suppressing plasticization. The preferred content of the crystalline resin described above also applies to the case where the crystalline resin is a form of the hybrid resin described above.

As the binder resin contained in the toner of the present invention, other amorphous resin such as an amorphous polyester resin may be contained in addition to the vinyl resin and the crystalline resin. The content of other amorphous resin is preferably 30% by mass or less relative to the total resin components in the toner, and it is more preferred that the content is 0% by mass, namely, other amorphous resin is not contained.

<Release Agent>

The toner base particles of the present invention contain a release agent. Specific examples of the release agent include low molecular weight polyolefins such as polyethylene, polypropylene and polybutene, oxidized polyolefins such as oxidized polyethylene and polypropylene, silicones showing a softening point by heating; fatty acid amides such as oleic acid amide, erucic acid amide, ricinoleic acid amide, stearic acid amide, ethylene diamine behenylamide and trimellitic acid tristearylamide; dialkyl ketone-based waxes such as distearyl ketone; plant-based waxes such as carnauba wax, rice wax, canderira wax, tree wax and jojoba oil; animal-based waxes such as beeswax; long chain hydrocarbon waxes such as paraffin wax and sasol wax; branched-chain hydrocarbon waxes such as microcrystalline wax and Fischer Tropsh wax; ester waxes such as montan wax, stearyl stearate, behenyl behenate, butyl stearate, propyl oleate, glyceride monostearate, glyceride distearate, pentaerythritol tetrabehenate, trimethylolpropane tribehenate, pentaerythritol diacetate dibehenate, glycerin tribehenate, diethylene glycol monostearate, dipropylene glycol distearate, diglyceride distearate, sorbitan monostearate, 1,18-octadecane diol distearate, tristearyl trimellitate, distearyl maleate and cholesteryl stearate; and the like. These release agents can be used singly or in combination of two or more kinds.

When using a monoester wax as a release agent, the lamellar crystal structure that is not in contact with a release agent according to the present invention tends to be formed. On the other hand, when using a hydrocarbon wax having few branches of the carbon chain and a small molecular weight distribution, as a release agent, the structure body according to the present invention tends to be formed. The reason is not known, but it is assumed that the lamellar crystal structure that is not in contact with a release agent according to the present invention and the structure body according to the present invention are formed respectively, depending on a balance of affinity with the crystalline resin and the surrounding resin. Therefore, it is preferred to use different kinds of release agents in combination, for coexisting the structure body and the lamellar crystal structure. For example, a hydrocarbon wax having few branches of the carbon chain and a small molecular weight distribution and a monoester wax having one ester bond are used in combination, so that a tendency to easily coexist the structure body and the lamellar crystal structure is observed. In addition, also when using a release agent singly, it is considered that the structure body and the lamellar crystal structure can be allowed to coexist, by balancing affinity with the crystalline resin and the surrounding resin. Specifically, for example, a hydrocarbon wax having many branches of the carbon chain and a relatively large molecular weight distribution, a polyvalent ester wax having a plurality of ester bonds and a release agent having a separated function structure having two or more kinds of functional groups by modification are used, so that the structure body and the lamellar crystal structure are easily allowed to coexist. Specifically, one of methods for realizing a constitution of "a structure body in which a crystalline resin is in contact with a release agent, and the crystalline resin having a lamellar crystal structure that is not in contact with the release agent are present in the cross section of the toner base particles" that is characterized in the present invention, as described above, includes a method of properly selecting a release agent.

As one example, the ratio of the use amount when a hydrocarbon wax having a small molecular weight distribution and a monoester wax having one ester bond are used in combination as a release agent, is preferably hydrocarbon wax:monoester wax=10/90 to 90/10 (mass ratio).

Branches of the carbon chain and the molecular weight distribution of the hydrocarbon wax can be measured, for example, by analyzing n-paraffin rate and the width of the distribution of the carbon number, using gas chromatograph analysis.

As a release agent, one having a melting point of 40 to 90° C. is preferably used, from the viewpoint of surely obtaining low-temperature fixability and releasability of the toner. The content ratio of the release agent in the toner is preferably 1 to 20% by mass and more preferably 5 to 20% by mass, relative to the total binder resin in the toner. By adopting the above content, the structure body and lamellar crystal structure described above are easily formed in the toner base particles.

<Existing Form of Crystalline Resin>

In the present invention, there is one characteristic in containing a structure body in which a crystalline resin is in contact with a release agent, and the crystalline resin having a lamellar crystal structure that is not in contact with the release agent, in the cross section of the toner base particles. Here, as long as the crystalline resin and the release agent are in contact with each other even at one point, it is included in the "structure body" according to the present invention, and means a complex body of the crystalline resin and the release agent. At this time, the crystal structure of the crystalline resin may be a lamellar crystal structure, and may be other structure (for example, fibrous crystal structure). Here, the "fibrous crystal structure" is one of the structures in which the crystalline resin constitutes a folding of the molecular chain and means a single (one strip) structure forming a lamellar structure.

Also, the "lamellar crystal structure" means a layered structure formed by crystallization by folding of the molecular chain of a crystalline resin, as described above. FIG. 1 is a photograph of toner base particle prepared using a hybrid crystalline polyester resin having a lamellar crystal structure that is subjected to ruthenium staining, then observed using a TEM (transmission electron microscope) (magnification: 50,000 times). As shown in FIG. 1, in the domain comprising the crystalline resin, a crystalline polyester resin segment combined in a comb shape forms a lamellar crystal structure.

Figure 2:
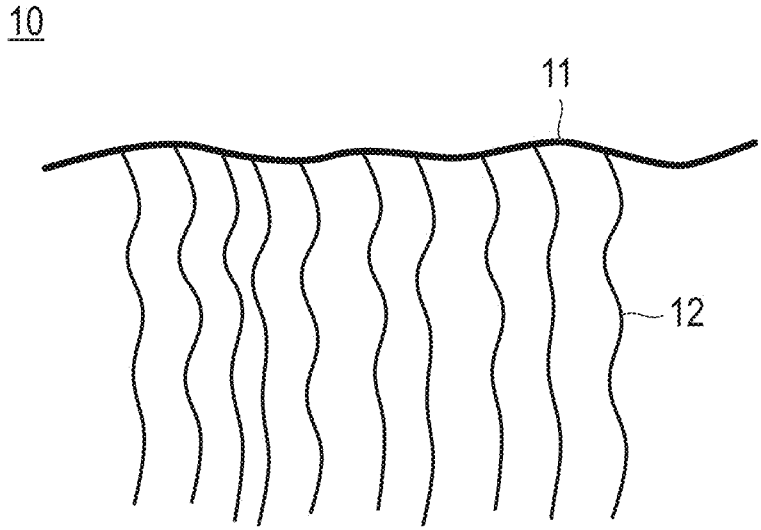
FIG. 2 is a schematic diagram showing a molecular structure of a hybrid crystalline polyester resin that is an example of a crystalline polyester resin forming a lamellar crystal structure.

FIG. 2 shows a schematic diagram of a hybrid crystalline polyester resin 10 that is an example of a crystalline polyester resin forming a lamellar crystal structure. The hybrid crystalline polyester resin 10 has a structure in which a crystalline polyester resin segment 12 is chemically bonded as a side chain to a vinyl resin segment 11 that is a main chain. As shown in FIG. 2, the crystalline polyester resin segment 12 is combined to the vinyl resin segment 11 in a comb shape. Such a comb shape structure is formed by the crystalline polyester resin segment 12 overlapped and crystallized in the vinyl resin. As a result, the lamellar crystal structure is formed.

In the above, the form in which the crystalline polyester resin is hybridized is described as a preferred form, but the lamellar crystal structure is not limited to the above form. Even only the crystalline polyester resin can take an overlapped structure, and consequently, the lamellar crystal structure can be formed.

Examples of a method for confirming the presence or absence of the structure body and lamellar crystal structure described above include a method of removing an external additive from the toner particles so as to obtain toner base particles, staining the toner base particles by ruthenium staining, and then observing the cross section of the toner base particles using a transmission electron microscope (TEM).

Figure 3:
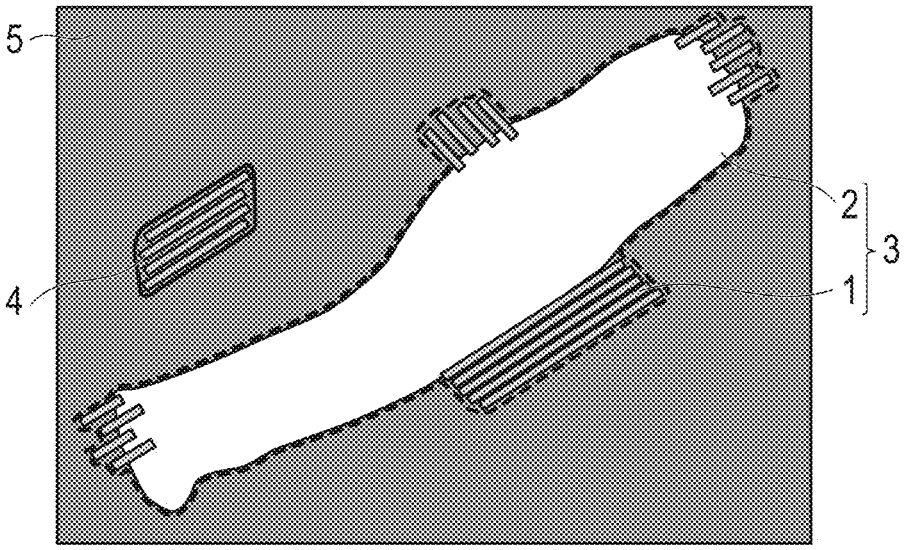
FIG. 3 is a schematic diagram when subjecting the cross section of the toner base particles by an embodiment of the present invention to ruthenium staining, and then observing it by a secondary electron image using a TEM (transmission electron microscope).

FIG. 3 is a schematic diagram when subjecting the cross section of the toner base particles obtained by an embodiment of the present invention to ruthenium staining, and then observing it by a secondary electron image using a TEM (transmission electron microscope). FIG. 3 shows an example of a structure body according to the present invention. As shown in FIG. 3, a domain of a structure body 3 (part surrounded by a dot line in FIG. 3) in which a crystalline resin 1 is in contact with a release agent 2 (part shown by white in FIG. 3), and a domain of a crystalline resin 4 (part surrounded by a solid line in FIG. 3) having a lamellar crystal structure that is not in contact with the release agent are present in a vinyl resin 5 as a matrix, in the cross section of the toner base particles according to one embodiment of the present invention.

In the observation by TEM, as to contrast, a more white contrast part was determined as a release agent. The amorphous resin is stained by ruthenium tetroxide, thus the crystalline material and the amorphous resin can be discriminated. Specifically, as shown in FIG. 3, by ruthenium staining, the release agent is stained lightest, then the crystalline resin having the lamellar crystal structure and the crystalline resin forming the structure body are stained dark, and the vinyl resin is stained darkest.

Specifically, the cross section of the toner base particles can be observed, for example, by the observation method (conditions) described in the following example.

When observing the cross section of any 100 toner base particles by the method described in examples, the toner base particles in which the structure body and the lamellar crystal structure are present in the cross section should be present in 60% (60 particles) or more, and are preferably present in 80% (80 particles) or more of the entire toner base particles. In the above range, the effect of the present invention can be sufficiently obtained.

Also, in the present invention, a structure other than the lamellar crystal structure that is not in contact with a structure body and a release agent, for example, a fibrous crystal structure that is not in contact with a release agent or the like, may be contained. Here, the "fibrous crystal structure" is as defined as above. However, for effectively obtaining the effect of the present invention, as to the structure of the crystalline resin other than the lamellar crystal structure that is not in contact with a structure body and a release agent, the ratio of the cross-sectional area is preferably less than 1%, relative to the cross section of the toner base particles, and is more preferably not present, specifically, the ratio of the cross-sectional area is 0%.

<<Structure Body>>

The shape of the structure body is not particularly limited. However, the average domain diameter of the structure body is preferably 200 to 2500 nm, more preferably 300 to 2000 nm, and particularly preferably 800 to 1500 nm. The average domain diameter is 200 nm or more, so that it is possible to suppress excessive compatibilization of the crystalline resin with the vinyl resin, suppress plasticization of the binder resin, and improve heat resistant storage property and offsetability of the high-temperature fixing area. Based on the above viewpoint, the average domain diameter is more preferably 300 nm or more, and particularly preferably 800 nm or more. On the other hand, the average domain diameter is 2500 nm or less, so that mixing of the structure body and the release agent which is present independently (specifically, the release agent that is not in contact with the crystalline resin) and occurrence of compatibilization are suppressed, thus increase in the viscosity of the release agent can be suppressed. Therefore, deterioration of post-fixing separability can be suppressed. Based on the above viewpoint, the average domain diameter is more preferably 2000 nm or less, and particularly preferably 1500 nm or less.

Here, the average domain diameter of the structure body can be controlled by the addition amount of the release agent, the composition of the crystalline resin, and the like. For example, when the addition amount of the release agent is increased, the average domain diameter of the structure body tends to be large. In addition, when the difference between the acid value of the crystalline resin and the acid value of the release agent is small, a structure body in which the crystalline resin is in contact with the release agent is likely to be formed. On the other hand, when the difference between these acid values is large, each tends to be present as a single crystal structure.

The "domain" herein refers to one having a structure that is present as an island shaped phase having a closed interface (boundary between phase and phase), and its length is defined as a domain diameter. More specifically, a value measured by the method described in examples is adopted as the average domain diameter of the structure body.

<<Lamellar Crystal Structure>>

The average domain diameter of the lamellar crystal structure is preferably 100 to 2000 nm, more preferably 300 to 1800 nm, further more preferably 500 to 1500 nm, and particularly preferably 600 to 1300 nm. The average domain diameter is set to 100 nm or more, so that, when the lamellar crystal structure melts during heat fixing, it is possible to easily obtain an effect of promoting deformation of the toner base particles. As a result, deterioration of post-fixing separability can be suppressed. Also, a phase separation effect with the vinyl resin can be sufficiently obtained, and plasticization of the binder resin can be suppressed. As a result, heat resistant storage property and offsetability of the high-temperature fixing area can be properly maintained. Based on the above viewpoint, the average domain diameter is more preferably 300 nm or more, further more preferably 500 nm or more, and particularly preferably 600 nm or more. On the other hand, the average domain diameter is set to 2000 nm or less, so that dispersibility of other additives such as a colorant and a release agent can be properly maintained, and consequently, the structure body and lamellar crystal structure according to the present invention are easily formed, and also the problem relating to developability can be suppressed. Based on the above viewpoint, the average domain diameter is more preferably 1800 nm or less, further more preferably 1500 nm or less, and particularly preferably 1300 nm or less.

The average domain diameter of the lamellar crystal structure can be controlled, for example, by the addition amount and composition of the crystalline resin, and when a toner is prepared using a dispersion liquid of the crystalline resin, the average domain diameter can be controlled by the dispersion diameter of the crystalline resin in the dispersion liquid of the crystalline resin. For example, when the addition amount of the crystalline resin is increased, or the dispersion diameter of the crystalline resin in the dispersion liquid of the crystalline resin is increased, the lamellar crystal structure tends to be large. Also, when a resin with a structure having a hybrid structure is used as the crystalline resin, it tends to be more easily to form a lamellar crystal structure. A value measured by the method described in examples is adopted as the average domain diameter of the lamellar crystal structure adopts.

<<Ratio of Cross-Sectional Area of Structure Body and Lamellar Crystal Structure>>

The ratio (defined as A) of the cross-sectional area of the structure body to the cross-sectional area of the toner base particles is preferably 1 to 25%, more preferably 3 to 20%, and particularly preferably 5 to 15%. When the ratio A of the cross-sectional area is 1% or more, excessive compatibilization with the vinyl resin can be suppressed, thus plasticization of the binder resin can be suppressed. As a result, deterioration of heat resistant storage property and offsetability of the high-temperature fixing area can be suppressed. Based on the above viewpoint, the ratio A of the cross-sectional area is more preferably 3% or more, and particularly preferably 5% or more. On the other hand, when the ratio A of the cross-sectional area is 25% by mass or less, so that mixing of the structure body and the single release agent (specifically, the release agent that is not in contact with the crystalline resin) and occurrence of compatibilization are suppressed, thus increase in the viscosity of the release agent can be suppressed. As a result, good post-fixing separability can be obtained. Based on the above viewpoint, the ratio A of the cross-sectional area is more preferably 20% or less, and particularly preferably 15% or less.

The ratio (defined as B) of the cross-sectional area of the lamellar crystal structure to the cross-sectional area of the toner base particles is preferably 1 to 25%, more preferably 3 to 20%, and particularly preferably 5 to 10%. When the ratio B of the cross-sectional area is 1% or more, the effect of promoting deformation of the toner base particles is easily obtained, and consequently, deterioration of post-fixing separability can be suppressed. Also, a phase separation effect with the vinyl resin can be sufficiently obtained, and plasticization of the binder resin can be suppressed. As a result, heat resistant storage property and offsetability of the high-temperature fixing area can be properly maintained. Based on the above viewpoint, the ratio B of the cross-sectional area is more preferably 3% or more, and particularly preferably 5% or more. On the other hand, the ratio B of the cross-sectional area is 25% or less, so that dispersibility of other additives such as a colorant and a release agent can be properly maintained, and consequently, the structure body and lamellar crystal structure according to the present invention are easily formed, and also the problem relating to developability can be suppressed. Based on the above viewpoint, the ratio B of the cross-sectional area is more preferably 20% or less, and particularly preferably 10% or less.

Furthermore, the total ratio (namely, A+B) of the cross-sectional area of the structure body and the lamellar crystal structure to the cross-sectional area of the toner base particles is preferably 1 to 50%, more preferably 1 to 30%, and particularly preferably 5 to 25%. The total ratio (A+B) of the cross-sectional area is within the above range, there is an advantage that sufficient document storability, post-fixing separability, and high-speed fixability can be secured.

Also, it is preferred that the ratio A of the cross-sectional area of the structure body and the ratio B of the cross-sectional area of the lamellar crystal structure satisfy the relation of the following equation (1).

[Equation 1]

$$0.1 \leq A/B \leq 5 \quad (1)$$

Specifically, the value of A/B described above is preferably 0.1 to 5, more preferably 0.3 to 3.5, and particularly preferably 0.5 to 2.5.

When the value of A/B is 0.1 or more, the abundance ratio of the structure body is relatively high, thus plasticization by compatibilization with the vinyl resin can be suppressed. In addition, the abundance ratio of the lamellar crystal structure is relatively low, so that dispersibility of other additives such as a colorant and a release agent can be properly maintained, and consequently, the structure body and lamellar crystal structure according to the present invention are easily formed, and also the problem relating to developability can be suppressed. Based on the above viewpoint, the value of A/B is more preferably 0.3 or more, and particularly preferably 0.5 or more. On the other hand, when the value of A/B is 5 or less, the abundance ratio of the lamellar crystal structure is relatively high, thus, when the lamellar crystal structure melts during heat fixing, it is possible to easily obtain an effect of promoting deformation of the toner base particles. As a result, deterioration of post-fixing separability can be suppressed. In addition, the abundance ratio of the structure body is relatively low, thus mixing of the structure body and the single release agent (specifically, the release agent that is not in contact with the crystalline resin) and occurrence of compatibilization are suppressed, thus increase in the viscosity of the release agent can be suppressed. As a result, good post-fixing separability can be obtained. Based on the above viewpoint, the value of A/B is more preferably 3.5 or less, and particularly preferably 2.5 or less.

A and B described above can be determined, for example, by the same apparatus and conditions as the ones adopted in the method for measuring the size of a structure body and a lamellar crystal structure described above, and specifically, can be determined using the method described in examples. As each cross-sectional area, an area surrounded by an external outline (for example, the structure body is an area surrounded by a dot line in FIG. 3, and the lamellar crystal structure is an area surrounded by a solid line in FIG. 3) is measured. An arithmetic average value for the toner base particles in which the structure body and the lamellar crystal structure were both observed, among the measured 100 toner base particles, is also calculated as the ratio of the cross-sectional area.

<<Existing Position of Structure Body and Lamellar Crystal Structure>>

The structure body and the lamellar crystal structure should be present in the cross section of the toner base particles, and the existing location thereof is not limited to a specific part. For example, each structure may be present in both the surface layer (surface) and inside of the toner base particles, but is preferably present inside of the toner base particles. More preferably, it is preferred that each structure is present in the region 0.1 times or more of the particle diameter of the toner base particles in depth, from the surface of the toner base particles. In such form, exposure of the crystalline resin to the surface of the toner base particles can be suppressed, thus chargeability can be improved, and oozing out of the release agent is facilitated, thus post-fixing separability, heat resistant storage property and flowability can be improved.

As described above, in order to make the structure body and the lamellar crystal structure, particularly, the lamellar crystal structure be present only inside of the toner base particles, for example, it is preferred to use the following methods (1) to (3).

(1) In the method for manufacturing a toner described later, adding a dispersion liquid of crystalline resin (crystalline polyester resin) fine particles before heating a dispersion liquid of constituents of the toner base particles;

(2) using a hybrid crystalline polyester resin as the crystalline resin (crystalline polyester resin); and (3) using a long chain acrylic ester as a monomer species of the binder resin other than the crystalline resin (crystalline polyester resin).

The above methods (1) to (3) may be used in proper combination.

<Colorant>

In the toner according to the present invention, the toner base particles may contain a colorant. The usable colorant includes known inorganic or organic colorants. Hereinbelow, specific colorants are shown.

Examples of black colorants include carbon black such as furnace black, channel black, acetylene black, thermal black and lamp black, and magnetic powder such as magnetite and ferrite.

Examples of colorants for magenta or red include C.I. Pigment Red 2, 3, 5, 6, 7, 15, 16, 48:1, 53:1, 57:1, 60, 63, 64, 68, 81, 83, 87, 88, 89, 90, 112, 114, 122, 123, 139, 144, 149, 150, 163, 166, 170, 177, 178, 184, 202, 206, 207, 209, 222, 238, and 269, and the like.

Also, examples of colorants for orange or yellow include C.I. Pigment Orange 31, and 43, C.I. Pigment Yellow 12, 14, 15, 17, 74, 83, 93, 94, 138, 155, 162, 180, and 185, and the like.

Furthermore, examples of colorants for green or cyan include C.I. Pigment Blue 2, 3, 15, 15:2, 15:3, 15:4, 16, 17, 60, 62, and 66, C.I. Pigment Green 7, and the like.

In addition, examples of dye include C.I. Solvent Red 1, 49, 52, 58, 63, 111, and 122, C.I. Solvent Yellow 2, 6, 14, 15, 16, 19, 21, 33, 44, 56, 61, 77, 79, 80, 81, 82, 93, 98, 103, 104, 112, and 162, C.I. Solvent Blue 25, 36, 60, 70, 93, and 95, and the like.

It is also possible to use these colorants singly or in combination of two or more kinds, as necessary. The content ratio of the colorant in the toner base particles is preferably 1 to 30% by mass and more preferably 2 to 20% by mass.

<Charge Control Agent>

The toner base particles according to the present invention may contain a charge control agent. Examples of the charge control agent include metal complexes of a salicylic acid derivative with zinc or aluminum (salicylic acid metal complex), calixarene compounds, organic boron compounds, fluorine-containing quaternary ammonium salt compounds, and the like.

The content ratio of the charge control agent is usually preferably 0.1 to 10 parts by mass, and more preferably 0.5 to 5 parts by mass, relative to 100 parts by mass of the binder resin in the toner.

<External Additive>

The toner base particles according to the present invention can be used as toner particles as they are, but from the viewpoint of improving charging performance and flowability as a toner, or cleaning performance, it is preferred to add particles such as known inorganic fine particles and organic fine particles, lubricant and the like to the surface of the toner particles, as an external additive. Various external additives may be used in combination. Examples of the particles include inorganic oxide fine particles such as silica fine particles, alumina fine particles, and titania fine particles, inorganic stearic acid compound fine particles such as aluminum stearate fine particles and zinc stearate fine particles, inorganic titanic acid compound fine particles such as strontium titanate fine particles and zinc titanate fine particles, and the like. Also, examples of the lubricant include metal salts of higher fatty acids such as salts of zinc, aluminum, copper, magnesium, calcium or the like of stearic acid, salts of zinc, manganese, iron, copper, magnesium or the like of oleic acid, salts of zinc, copper, magnesium, calcium or the like of palmitic acid, salts of zinc and calcium of linoleic acid, and salts of zinc and calcium of ricinoleic acid. These external additives may be surface-treated with a silane coupling agent or titanium coupling agent, a higher fatty acid, a silicone oil or the like, from the viewpoint of heat-resistant storage property and environmental stability.

The addition amount of the external additive is preferably 0.05 to 5 parts by mass, relative to 100 parts by mass of the toner base particles.

<Form of Toner Base Particles>

In the toner according to the present invention, the toner base particles may have a so-called single layer structure, and also may have a core-shell structure (i.e. the form in which a resin forming a shell part is aggregated and fused on the surface of core particles). The toner base particles having the core-shell structure have a resin area (shell part) having a relatively high glass transition point, on the surface of resin particles (core particles) having a relatively low glass transition point containing a colorant, a release agent, and the like.

The core-shell structure is not limited to a structure in which the shell part completely covers the core particles, but also includes, for example, a structure in which the shell part does not completely cover the core particles, and the core particles are exposed in some places.

It is possible to confirm the cross sectional structure of the core-shell structure, for example, using a known means such as transmission electron microscope (TEM) or a scanning probe microscope (SPM).

For the purpose of improving preservation stability of the toner, it is preferred that the toner base particles have a core particle and a shell part covering the surface of the core particles. A resin constituting the shell part is not particularly limited as long as it satisfies the above characteristics, but more preferably contains the above-described vinyl resin. When a vinyl resin is contained as the shell part, there is no great difference from a structure of a vinyl resin constituting the structure body and the lamellar crystal structure together with the toner base particles, thus oozing out of a release agent is not likely to be suppressed, and consequently, deterioration of post-fixing separability can be suppressed.

The content of the core particles (the core part) is preferably 30 to 95% by mass, relative to 100% by mass of the total resin amount of the core particle (the core part) and the shell part. Also, the content of the shell part is preferably 5 to 70% by mass, relative to 100% by mass of the total resin amount of the core particle (the core part) and the shell part.

<Average Circularity of Toner>

With regard to the toner according to the present invention, the average circularity of each individual toner particle which constitutes the toner is preferably 0.920 to 1.000, and more preferably 0.940 to 0.995, from the viewpoint of stability of charge characteristics and low-temperature fixability. When the average circularity falls within the aforementioned range, fracturing of each individual toner particle can be suppressed, and thus pollution of a triboelectric charging member can be suppressed. Accordingly, chargeability of the toner is stabilized, and high image quality is obtained for an image to be formed. The average circularity of the toner is a value measured by using "FPIA-2100" (manufactured by Sysmex Corporation). Specifically, a measurement sample (toner) is wetted with an aqueous solution containing a surfactant, followed by being dispersed via an ultrasonic dispersion treatment for one minute. Thereafter, the dispersion of toner particles is photographed with "FPIA-2100" (manufactured by Sysmex Corporation) in the measurement condition of HPF (high power field) mode at an appropriate density of the HPF detection number of 3,000 to 10,000. The circularity is calculated for each toner particle according to the following equation, and the added circularity of each toner particle is divided by the total number of the toner particles. The HPF detection number falling within the above-described range makes it possible to realize reproduction.

Circularity=(Circumference length of a circle having an equivalent to a projection area of a particle image)/(Circumference length of a projection image of a particle).

<Particle Diameter of Toner>

The volume-based median diameter (volume average particle diameter) of the toner (toner particles) of the present invention is preferably 3 to 10 μm, and more preferably 4 to 8 μm. When the median diameter falls within the aforementioned range, reproducibility of fine lines and improvement in image quality of a photographic image can be achieved, and also the toner consumption can be reduced as compared to the case of using a toner having a large particle size. In addition, toner flowability can be also secured. The volume average particle diameter of the toner can be controlled by the concentration of an aggregating agent or the addition amount of a solvent, or time for fusion, furthermore, composition of the resin component or the like, in the aggregation and fusion step during manufacturing the toner described later. The volume-based median diameter of the toner (toner particles) can be measured, for example, by "Multisizer 3" (manufactured by Beckman Coulter, Inc).

[Method for Manufacturing Toner]

Examples of the method for manufacturing a toner of the present invention include a pulverization method, a polymerization method, and other known methods. The polymerization method includes an emulsion aggregation (polymerization) method, an association aggregation method, a dispersion polymerization method, a mini-emulsion method, other known methods, and the like. Among them, as the method for manufacturing a toner containing a crystalline resin, that is capable of controlling the shape to be uniform in particle size, a manufacturing method by an emulsion aggregation (polymerization) method is preferable. The method is preferable in that shape controllability can be obtained by adding a specific inorganic salt to an aqueous medium, and further, in that progress of crystal growth is easily controlled, from the viewpoint of thermodynamic stability. Also, the emulsion aggregation method is more preferred since the particle size of the toner base particles can be easily reduced, from the viewpoint of production cost and production stability.

As a manufacturing method for realizing a constitution of "a structure body in which a crystalline resin is in contact with a release agent, and the crystalline resin having a lamellar crystal structure that is not in contact with the release agent are present in the cross section of the toner base particles" that is characterized in the present invention, a manufacturing method having a cooling step after controlling particle diameter and shape of the toner base particles is preferred.

It is assumed that aggregation of the crystalline material (for example, crystalline resin and release agent) can be prevented by carrying out this cooling step, thus coexisting state of the structure body and the lamellar crystal structure is easily formed. In the cooling step, rapid cooling is preferred. As rapid cooling, the temperature lowering rate is 8° C./min or more, as a guide, while it also depends on the temperature before cooling and the target temperature after cooling. This cooling step (preferably, rapid cooling) is performed after controlling particle diameter and shape of the toner base particles, so that coexisting state of the structure body in which a crystalline resin is in contact with a release agent, and the crystalline resin having a lamellar crystal structure that is not in contact with the release agent and is independently present is more easily maintained. In the case of using an emulsion aggregation method, it is more preferred that the toner base particles are aggregated until having a desired particle size, further, fusing between resin particles is performed to control the shape, then cooling (preferably, quenching) is performed.

The emulsion aggregation method is a method for manufacturing toner base particles by mixing a dispersion liquid of particles of the resin (hereinafter, also referred to as "resin particles") manufactured by emulsification with a dispersion liquid of particles of the colorant (hereinafter, also referred to as "colorant particles"), as necessary, and aggregating the mixture until having a desired particle size, further performing fusion between resin particles to control the shape. Here, the resin particles may contain a release agent, and a charge control agent or the like, as necessary.

Hereinafter, the emulsion aggregation method that is a preferred manufacturing method of toner will be described below.

<Emulsion Aggregation Method>

As described above, the emulsion aggregation method is a method for forming toner base particles by mixing a dispersion liquid of resin particles dispersed by a surfactant and a dispersion stabilizer with a dispersion liquid of constituents of the toner base particles such as colorant particles, as necessary, and aggregating the mixture until having a desired particle diameter by adding an aggregating agent, thereafter, or at the same time as aggregation, performing fusion between resin fine particles to control the shape.

For example, an aqueous dispersion liquid of crystalline resin particles, an aqueous dispersion liquid of release agent-containing vinyl resin particles, and an aqueous dispersion liquid of colorant particles are mixed, and each particle is aggregated, subsequently, fused, so that the toner base particles according to the present invention can be formed. Also, not the aqueous dispersion liquid of release agent-containing vinyl resin particles, but an aqueous dispersion liquid of release agent particles, and an aqueous dispersion liquid of vinyl resin particles may be separately prepared and mixed. Also, an aqueous dispersion liquid of crystalline resin-containing vinyl resin particles, and an aqueous dispersion liquid of crystalline resin and release agent-containing vinyl resin particles can be used.

When the toner base particles are manufactured by emulsion aggregation method, for example, a manufacturing method including the following each step is adopted. Here, the following example is described for a case where vinyl resin particles contain a release agent, crystalline resin particles are crystalline polyester resin particles, and further toner base particles contain a colorant. However, the technical scope of the present invention is not limited to these embodiments.

(a) step of preparing a dispersion liquid of crystalline polyester resin particles in an aqueous medium;

(b) step of preparing a dispersion liquid containing vinyl resin particles containing a release agent in an aqueous medium;

(c) step of preparing a dispersion liquid of colorant particles in an aqueous medium;

(d) step of mixing the dispersion liquid of crystalline polyester resin particles, the dispersion liquid of release agent-containing vinyl resin particles, and the dispersion liquid of colorant particles;

(e) step of aggregating and fusing the crystalline polyester resin particles, the release agent-containing vinyl resin particles, and the colorant particles;

(f) step of aging the aggregated and fused particles with thermal energy to adjust the shape of the toner base particles; and (g) step of cooling a dispersion liquid of the toner base particles.

After the step of (g) above, further, (h-1) washing and drying step of filtering toner base particles from the aqueous dispersion liquid of the toner base particles, washing to remove the surfactant and the like from the toner base particles, and drying the washed toner base particles, (h-2) external additive treatment step of adding an external additive to the dried toner base particles, and the like, are performed as necessary, so that toner particles can be manufactured.

<<(a) Step of Preparing a Dispersion Liquid of Crystalline Polyester Resin Particles>>

This step preferably includes the following steps.

(A-1) Step of synthesizing a crystalline polyester resin; and (A-2) Step of preparing a dispersion liquid of crystalline polyester resin particles.

(A-1) Step of Synthesizing a Crystalline Polyester Resin

The method for manufacturing the crystalline polyester resin is not particularly limited, and the resin can be manufactured by a general polyester polymerization method that reacts a polycarboxylic acid and a polyhydric alcohol, for example, by properly using direct polycondensation, transesterification method, or the like, depending on the kind of monomer. As a catalyst usable when manufacturing a crystalline polyester resin, one similar to the catalyst for synthesizing the crystalline polyester resin segment described above, thus detail explanation is omitted herein.

As the usage ratio of the polyhydric alcohol and the polycarboxylic acid, the equivalence ratio [OH]/[COOH] of a hydroxy group [OH] of the polyhydric alcohol to a carboxyl group [COOH] of the polycarboxylic acid is preferably 1.5/1 to 1/1.5, and more preferably 1.2/1 to 1/1.2. In addition, the polymerization temperature and the polymerization time are not particularly limited, and during polymerization, the pressure in the reaction system may be reduced as necessary.

(A-2) Step of Preparing a Dispersion Liquid of Crystalline Polyester Resin Particles (2) The step of preparing a dispersion liquid of crystalline polyester resin particles is a step of dispersing in a fine particulate state the crystalline polyester resin synthesized above in an aqueous medium to prepare a dispersion liquid of crystalline polyester resin particles.

Examples of the method for preparing a dispersion liquid of crystalline polyester resin particles include (i) a method of performing dispersion treatment of the crystalline polyester resin in an aqueous medium, without using a solvent, (ii) a method of dissolving a crystalline polyester resin in a solvent such as ethyl acetate, methyl ethyl ketone and toluene, to be a solution, and emulsifying and dispersing the solution in an aqueous medium using a disperser, then performing desolvation treatment (desolvation step), and the like.

The "aqueous medium" used in (i) and (ii) described above refers to one containing at least 50% by mass or more of water, and the component other than water includes organic solvents which dissolve in water. Examples include methanol, ethanol, isopropanol, butanol, acetone, dimethylformamide, methyl cellosolve, tetrahydrofuran, and the like. Among them, an alcoholic organic solvent like methanol, ethanol, isopropanol or butanol that is an organic solvent not dissolving a resin is preferably used. More preferably, only water is used as an aqueous medium.

Furthermore, amine or ammonia may be dissolved in the aqueous medium for stably emulsifying to a water phase and smoothly proceeding emulsification, and a surfactant, resin fine particles or the like may be added for the purpose of improving dispersion stability of oil droplets.

As the surfactant, a known anionic surfactant, cationic surfactant, nonionic surfactant or amphoteric surfactant can be used. As the surfactant, an anionic surfactant is preferably used since it is excellent dispersion stability of oil droplets of the crystalline polyester resin, and stability to temperature change can be obtained. Known anionic surfactant can be used, and can be used singly or in combination of two or more kinds, as desired.

In addition, the resin fine particles for improving dispersion stability includes polymethyl methacrylate resin fine particles, polystyrene resin fine particles, polystyrene/acrylonitrile resin fine particles, and the like.

In the (ii), the synthesized crystalline polyester resin is dissolved in an organic solvent to prepare a crystalline polyester resin solution. Thereafter, the crystalline polyester resin solution is emulsified and dispersed in an aqueous medium, thereby forming an oil droplet composed of the crystalline polyester solution. In this step, when using a phase inversion emulsification method, an oil droplet can be uniformly dispersed by changing stability of a carboxyl group of polyester, and it is excellent in that the oil droplet is not forced to disperse by shear force as in a mechanical emulsification method. In the "phase inversion emulsification method", a dispersion liquid of the resin fine particles is obtained by undergoing a dissolution step of dissolving a resin in an organic solvent to obtain a resin solution, a neutralization step of charging a neutralizing agent into the resin solution, and emulsification step of emulsifies and disperses the neutralized resin solution in an aqueous dispersion medium to obtain a resin emulsion, and a desolvation step of removing the organic solvent from the resin emulsion.

The dispersion treatment (emulsion dispersion) in the (i) and (ii) can be carried out using a mechanical energy, and the disperser is not particularly limited, and includes a wet emulsifying disperser, a homogenizer, a low speed shearing disperser, a high speed shearing disperser, a friction disperser, a high pressure jet disperser, an ultrasonic disperser, a high pressure impact type disperser ULTIMIZER, and the like.

Here, the particle diameter of the crystalline polyester resin particles in the dispersion liquid can be controlled by adjusting the added amount of the neutralizing agent, namely, adjusting the neutralization degree. Here, the smaller the added amount of the neutralizing agent, namely, the lower the neutralization degree, the particle diameter of the resin particles in the dispersion liquid tends to be large.

In the method of the (ii), the organic solvent is distilled away from the formed oil droplets, so that the crystalline polyester resin particles are generated, and the dispersion liquid of the crystalline polyester resin particles is prepared. Distillation of the organic solvent is specifically preferably carried out at a temperature within the range of 30 to 50° C., in a state at a degree of vacuum within the range of 400 to 50000 Pa.

The particle diameter of the crystalline polyester resin particles is, for example, preferably in the range of 30 to 500 nm, in terms of a volume-based median diameter. The particle diameter of the crystalline polyester resin particles can be measured, for example, by dynamic light scattering method using "Microtrac UPA-150" (manufactured by Nikki Trading Corp.).

The dispersion diameter of the crystalline polyester resin particles (oil droplet) in the dispersion liquid of the crystalline polyester resin particles prepared as described above is preferably 30 to 500 nm, in terms of a volume-based median diameter (volume average particle diameter). The dispersion diameter of this oil droplet can be controlled also by the magnitude of the mechanical energy during emulsion dispersion and the like. The dispersion diameter of the crystalline polyester resin particles (oil droplet) can be measured, for example, by dynamic light scattering method using "Microtrac UPA-150" (manufactured by Nikki Trading Corp.).

In addition, the content of the crystalline polyester resin particles in the dispersion liquid of the crystalline polyester resin particles is preferably in the range of 10 to 50% by mass and more preferably in the range of 15 to 40% by mass, relative to 100% by mass of the dispersion liquid. In the above range, the spread of the particle size distribution can be suppressed, and the toner characteristics can be improved.

<<(b) Step of Preparing a Dispersion Liquid-Containing Vinyl Resin Particles-containing a Release Agent (a Dispersion Liquid of Release Agent Containing Vinyl Resin Particles)>>

This step is a step of synthesizing a vinyl resin constituting toner base particles, dispersing this vinyl resin in a particulate state in an aqueous medium, and further adding a release agent to prepare a dispersion liquid of vinyl resin particles.

The method for manufacturing a vinyl resin is as described above, thus the detail is omitted.

Examples of the method for dispersing a vinyl resin in an aqueous medium include (I) a method of forming vinyl resin particles from a monomer for obtaining a vinyl resin to prepare an aqueous dispersion liquid of the vinyl resin particles, (II) a method of dissolving or dispersing a vinyl resin in an organic solvent (solvent) to prepare an oil phase liquid, dispersing the oil phase liquid in an aqueous medium by phase inversion emulsification or the like, and forming an oil droplet in a state controlled to the desired particle diameter, then removing the organic solvent (solvent), and the like. In these methods (I) and (II), a release agent is preferably added, together with a vinyl resin monomer (or vinyl resin).

In the method (I), it is preferred to use the following procedure. First, a monomer for obtaining a vinyl resin is added to an aqueous medium, together with a polymerization initiator, to obtain elementary particles. Next, a radical polymerizable monomer and a polymerization initiator for obtaining a vinyl resin are added to a dispersion liquid in which the elementary particles are dispersed, and seed polymerizing of the radical polymerizable monomer with the elementary particles is performed. When adding the radical polymerizable monomer and the polymerization initiator, it is preferred to also add a release agent at the same time.

At this time, a water-soluble polymerization initiator can be used as the polymerization initiator. As the water-soluble polymerization initiator, for example, a water-soluble radical polymerization initiator such as potassium persulfate or ammonium persulfate can be preferably used.

Also, in a seed polymerization reaction system for obtaining vinyl resin particles, for the purpose of adjusting the molecular weight of the vinyl resin, a generally used chain transfer agent can be used. As the chain transfer agent, octylmercaptan, dodecylmercaptan, t-dodecylmercaptan, n-octyl-3-mercaptopropionate, stearyl-3-mercaptopropionate, styrene dimer, or the like can be used.

In the method (II), as the organic solvent (solvent) used in the preparation of an oil phase liquid, one having low boiling point, and having low solubility in water is preferable, from the viewpoint that removal treatment after forming oil droplets is easy, as described above, and specific examples include methyl acetate, ethyl acetate, methyl ethyl ketone, methyl isobutyl ketone, toluene, xylene, and the like. These compounds can be used singly, or in combination of two or more kinds.

The use amount of the organic solvent (solvent) (the total used amount thereof when using two or more kinds) is usually 10 to 500 parts by mass, relative to 100 parts by mass of the vinyl resin.

The use amount of the aqueous medium is preferably 50 to 2,000 parts by mass, relative to 100 parts by mass of the oil phase liquid. The use amount of the aqueous medium is within the above range, so that the oil phase liquid can be emulsified and dispersed with the desired particle diameter in the aqueous medium.

Moreover, a dispersion stabilizer, a surfactant, resin fine particles or the like may be added to the aqueous medium, as described above. The emulsion dispersion of the oil phase liquid can be carried out using a mechanical energy as described above. The disperser for carrying out emulsion dispersion is not particularly limited, and those explained in (A-2) above can be used.

Removal of the organic solvent after forming oil droplets can be carried out by operation of gradually increasing the temperature of the whole dispersion liquid in which the vinyl resin particles are dispersed in an aqueous medium, in a stirred state, and vigorously stirring the dispersion liquid in the constant temperature range, then carrying out desolvation, and the like. Alternatively, the organic solvent can be removed while reducing a pressure using an apparatus such as an evaporator.

In the method (II), an separately prepared aqueous dispersion liquid of the release agent (release agent particles dispersion liquid) was added to a dispersion liquid-containing the obtained vinyl resin particles to prepare a release agent-containing vinyl resin particles dispersion liquid.

As the aqueous medium, surfactant, resin fine particles and the like used for preparing the aqueous dispersion liquid of the release agent, those described in (A-2) above can be used. The dispersion of the release agent can be carried out using a mechanical energy. The disperser is not particularly limited, and those explained in (A-2) above can be used.

The content of the release agent particles in the release agent particles dispersion liquid is preferably in the range of 10 to 50% by mass, and more preferably in the range of 15 to 40% by mass. In the above range, effects of preventing hot-offset and securing separability are obtained.

The dispersion diameter of the vinyl resin particles (oil droplet) in the dispersion liquid of the vinyl resin particles prepared in the methods (I) or (II) above is preferably 60 to 1000 nm, in terms of a volume-based median diameter (volume average particle diameter). The dispersion diameter of this oil droplet can be controlled by the magnitude of the mechanical energy during emulsion dispersion and the like.

Also, the content of the vinyl resin particles in the dispersion liquid of vinyl resin particles is preferably in the range of 5 to 50% by mass, and more preferably in the range of 10 to 30% by mass. In the above range, the spread of the particle size distribution can be suppressed, and the toner characteristics can be improved.

Here, the vinyl resin particles also can be composite particles composed of a plurality of layers constituting two or more layers made of resins having different compositions.

<<(c) Step of Preparing a Dispersion Liquid of Colorant Particles>>

The step of preparing a dispersion liquid of colorant particles is a step of dispersing the colorant particles in a particulate state in an aqueous medium to prepare a dispersion liquid of the colorant particles. The dispersion treatment of the colorant is preferably carried out in an aqueous medium with a surfactant concentration of the critical micelle concentration (CMC) or more since the colorant is uniformly dispersed.

The aqueous medium is as described in (A-2) above, and a surfactant, resin fine particles or the like may be added to the aqueous medium, for the purpose of improving dispersion stability. In addition, the dispersion of the colorant can be carried out using a mechanical energy. The disperser is not particularly limited, and those explained in (A-2) above can be used.

The dispersion diameter of the colorant particles in the dispersion liquid of colorant particles is preferably in the range of 10 to 300 nm, in terms of a volume-based median diameter. The dispersion diameter of the colorant particles in the dispersion liquid of colorant particles can be measured, for example, by dynamic light scattering method using "Microtrac UPA-150" (manufactured by Nikki Trading Corp.).

The content of the colorant in the dispersion liquid of colorant particles is preferably in the range of 10 to 50% by mass, and more preferably in the range of 15 to 40% by mass. In the above range, an effect of securing color reproducibility is obtained.

<<(d) Mixed Liquid Preparation Step and (e) Aggregation and Fusion Step>>

In the mixed liquid preparation step, each particle dispersion liquid prepared in the steps of (a) and (b) above is mixed. At this time, the dispersion liquid of colorant particles prepared in the step of (c) above may be further mixed, as necessary. The order of addition of each dispersion liquid and the like is not particularly limited, and the conditions such as stirring rate are not also particularly limited. Moreover, in this step, in addition to each dispersion liquid described above, colorant particles, a release agent, a charge control agent, and other constituents of the toner base particles may be mixed as necessary.

The aggregation and fusion step carried out after or at the same time as the mixed liquid preparation step is a step for obtaining toner base particles by aggregating the crystalline polyester resin particles and release agent-containing vinyl resin particles described above, colorant particles, a release agent, a charge control agent, and other constituents of the toner base particles added as necessary, in an aqueous medium, and simultaneously fusing these particles.

A specific method of aggregating and fusing the crystalline polyester resin particles and the release agent-containing vinyl resin particles, and colorant particles used as necessary includes the following method. First, an aggregating agent is added to an aqueous medium so as to have a critical aggregation concentration or more, and subsequently, the solution is heated to a temperature of a glass transition point or more of the resin particles, and a melting peak temperature or less of the mixture, thereby proceeding salting-out of particles such as crystalline polyester resin particles, release agent-containing vinyl resin particles and colorant particles, and simultaneously proceeding fusing in parallel. Moreover, an aggregation stopping agent is added to stop particle growth at a point that the particles are grown to have a desired particle size, and further heating is continued to control the particle shape as necessary. In this method, it is preferred to shorten the time to be left after adding the aggregating agent as much as possible, and heat rapidly the solution to a temperature of a glass transition point or more of these resin particles, and a melting peak temperature or less of the mixture. The time until this temperature increase is usually preferably within 30 minutes, and more preferably within 10 minutes. Also, the temperature increase rate is preferably 1° C./min or more. The upper limit of the temperature increase rate is not particularly limited, but is preferably 15° C./min or less, from the viewpoint of suppressing generation of coarse particles by rapid progress of fusion. Furthermore, it is important to continue fusion by holding the temperature of the reaction system for a certain time, after a temperature of the reaction system reaches to the glass transition point or more of resin particles. Accordingly, growth of the toner base particles and fusion can be effectively progressed, and durability of finally obtained toner particles can be improved. In the present invention, in the aggregation and fusion step, the dispersion liquid of crystalline polyester resin particles and the dispersion liquid of release agent-containing vinyl resin particles may be dividedly added into a first stage and a second stage.

The aggregating agent used in this aggregation and fusion step is not particularly limited, but one selected from metal salts is preferably used. Examples of the metal salt include monovalent metal salts such as salts of alkali metals such as sodium, potassium and lithium; divalent metal salts such as calcium, magnesium, manganese and copper; trivalent metal salts such as iron and aluminum, and the like. Examples of specific metal salts include sodium chloride, potassium chloride, lithium chloride, calcium chloride, magnesium chloride, zinc chloride, copper sulfate, magnesium sulfate, manganese sulfate, and the like, and among them, a divalent metal salt is particularly preferably used since aggregation can be progressed in a smaller amount. These compounds can be used solely, or in their combination of two kinds or more. The particle diameter of the toner base particles obtained in this aggregation and fusion step is, for example, preferably in the range of 2 to 9 μm, and more preferably in the range of 4 to 7 μm, in terms of a volume-based median diameter (volume average particle diameter). The volume-based median diameter of the toner base particles can be measured, for example, by "particle size distribution measuring device Multisizer 3" (manufactured by Beckman Coulter, Inc).

When the toner base particles having a core-shell structure is prepared, the aqueous dispersion liquid of a resin to form a shell part is further added, and the resin to form a shell part is aggregated and fused on the surface of the resin particles (core particles) of a single layer structure obtained as above. Accordingly, the toner base particles having a core-shell structure are prepared (shell forming step). At this time, following the shell forming step, it is preferred to further carry out heating treatment of reaction system, namely, (f) aging step described later until aggregation and fusion of the shell part on the surface of core particles are consolidated, and the shape of particles becomes a desired shape. This heating treatment of reaction system may be carried out until the average circularity of the toner base particles having a core-shell structure falls within the aforementioned range of average circularity.

<<(f) Aging Step>>

The shape of the toner base particles in the toner can be uniformized to a certain degree by the control of heating temperature in the aggregation and fusion step described above, and it is preferred to undergo an aging step, for further uniformizing the shape. In this aging step, the heating temperature and heating time are controlled, thereby controlling the surface of the toner base particles formed to have a constant particle diameter with narrow distribution, to have a smooth and uniform shape. Specifically, the heating temperature is lowered in the aggregation and fusion step to suppress fusion between the resin particles and promote uniformalizing, and also in this aging step, the heating temperature is controlled lower, and the time is prolonged so that the toner base particles have a desired average circularity, namely, have a uniform surface shape. The average circularity is preferably 0.920 to 1.000.

<<(g) Cooling Step>>

After the average circularity of toner base particles reaches to a desired range, cooling of a dispersion liquid is carried out. At this time, by controlling the cooling conditions, the presence state (for example, domain diameter, shape and existing position of each material, etc.) in the toner base particles of the material constituting each toner base particle varies. When the cooling rate is reduced, for example, aggregation of crystalline materials will be promoted, and crystal growth may occur. On the other hand, when the cooling rate is increased, for example, aggregation of crystalline substances will be suppressed, and the structure in the aging step tends to be maintained without promoting crystallization. The temperature lowering rate to facilitate generation of a coexistence state of the structure body and the lamellar crystal structure that is a characteristic of the present invention is preferably 8° C./min or more, as a guide.

The cooling method is not particularly limited, and a method of cooling the dispersion liquid by introducing a refrigerant from the outside of the reaction vessel, and a method of cooling the dispersion liquid by directly adding cool water to the reaction system can be exemplified.

<<(h-1) Washing and Drying Step>>

The washing and drying step can be carried out by adopting various known methods. Specifically, the toner base particles are aged to have a desired average circularity in the above aging step, and cooled, then subjected to solid-liquid separation, for example, using a known apparatus such as a centrifugal separator, and washed. The washing treatment is to perform water washing until the electric conductivity of the filtrate reaches, for example, a level of 5 to 10 μS/cm.

In the drying step, the washed toner base particles are subjected to a drying treatment. In the drying, the organic solvent is removed by reduced-pressure drying as necessary, then water and a minute amount of an organic solvent are further removed by a known drying apparatus such as a flush jet drier and a fluidized bed drying apparatus. The drying temperature should be in the range that the toner base particles are not fused. The water amount contained in the dried toner base particles is preferably 5% by mass or less, and more preferably 2% by mass or less.

Also, when the dried toner base particles aggregate each other by a weak interparticle attractive force, the aggregate may be subjected to a crushing treatment.

<<(h-2) External Additive Treatment Step>>

The external additive treatment step is a step of adding and mixing the dried toner base particles with an external additive as necessary, to prepare toner particles. Here, the kind and preferred addition amount of the external additive are as described above, thus the explanation is omitted. The method of adding an external additive includes a dry method of adding an external additive in a powder form to the dried toner base particles, and the mixing device includes mechanical mixing devices such as a Henschel mixer and a coffee mill.

[Developer for Electrostatic Charge Image Developing]

The toner of the present invention can be used as a magnetic or non-magnetic one-component developer, and also may be mixed with a carrier and used as a two-component developer. When the toner is used as a two-component developer, magnetic particles made of conventionally known material such as a metal such as iron, ferrite or magnetite, an alloy of the foregoing metal and a metal such as aluminum or lead can be used as a carrier, and a ferrite particle is particularly preferred. Also, as a carrier, a coated carrier prepared by coating the surface of magnetic particles with a coating agent such as a resin, and a dispersion carrier prepared by dispersing magnetic fine powder in a binder resin.

The volume-based median diameter of the carrier is preferably from 20 to 100 μm, and more preferably from 25 to 80 μm. The volume-based median diameter of the carrier can be measured representatively by a laser diffraction type particle size distribution meter "HELOS" (manufactured by SYMPATEC Co).

EXAMPLES

The effect of the present invention will be described using the following examples and comparative examples. In the following examples, the terms "part" and "%" mean "part by mass" and "% by mass", respectively, unless otherwise noted, and each operation was carried out at room temperature (25° C.). The present invention is not limited to the following examples.

<Preparation of Toner>

[Preparation of Crystalline Resin]

Synthesis Example 1

Synthesis of Hybrid Crystalline Polyester Resin (1)

A raw material monomer of an addition polymerization resin (styrene-acrylic resin: StAc1) segment of the composition shown below including a bireactive monomer, and a radical polymerization initiator, were added to a dropping funnel.

Styrene 34 parts by mass n-Butyl acrylate 12 parts by mass

Acrylic acid 2 parts by mass

Polymerization initiator (di-t-butyl peroxide) 7 parts by mass

Also, a raw material monomer of the following polycondensation resin (crystalline polyester resin: CPEs1) segment was added to a four-neck flask equipped with a nitrogen introducing tube, a dewatering tube, a stirrer and a thermocouple, and dissolved by heating to 170° C.

Tetradecanedioic acid 271 parts by mass 1,6-Hexanediol 118 parts by mass

Subsequently, the raw material monomer of an addition polymerization resin (StAc1) was added dropwise over 90 minutes while stirring the content of the flask, and the mixture was aged for 60 minutes, then the unreacted raw material monomer of addition polymerization resin was removed under reduced pressure (8 kPa). The amount of monomer removed at that time was a very small amount relative to the amount of raw material monomer of the resin.

Thereafter, 0.8 parts by mass of $Ti(O\text{-}n\text{-}Bu)_4$ was added as an esterification catalyst, and the temperature was raised to 235° C., then the reaction was performed under normal pressure (101.3 kPa) for 5 hours and further under reduced pressure (8 kPa) for 1 hour.

Next, the reaction mixture was cooled to 200° C., then reacted under reduced pressure (20 kPa) for 1 hour to obtain a hybrid crystalline polyester resin (1). The content (hybrid rate: HB rate) of a resin (StAc1) segment other than CPEs relative to 100% by mass of the total amount of the hybrid crystalline polyester resin (1) was 10% by mass. Also, the hybrid crystalline polyester resin (1) was a resin having a form in which the CPEs segment was grafted to the StAc segment. In addition, the hybrid crystalline polyester resin (1) had a number average molecular weight (Mn) of 5,900 and a melting point (Tm) of 75.2° C.

Synthesis Examples 2 to 4

Synthesis of Hybrid Crystalline Polyester Resins (2) to (4)

The same procedures were carried out as in Synthesis Example 1, except for changing the content (HB rate) of a resin (StAc1) segment other than CPEs relative to 100% by mass of the total amount of the hybrid crystalline polyester resin to the content shown in Table 1 below to obtain each of hybrid crystalline polyester resins (2) to (4). The number average molecular weights (Mn) and melting points (Tm) of the hybrid crystalline polyester resins (2) to (4) are respectively shown in Table 1 below.

Synthesis Example 5

Synthesis of Hybrid Crystalline Polyester Resin (5)

The same procedures were carried out as in Synthesis Example 1, except for using a raw material monomer of an addition polymerization resin (styrene-acrylic resin: StAc2) segment of the composition shown below and a radical polymerization initiator in order to form an addition polymerization resin (StAc) segment, to obtain a hybrid crystalline polyester resin (5). The number average molecular weight (Mn) and melting point (Tm) of the hybrid crystalline polyester resin (5) are shown in Table 1 below.

Styrene 32 parts by mass n-Butyl acrylate 11 parts by mass

Acrylic acid 5 parts by mass

Polymerization initiator (di-t-butyl peroxide) 7 parts by mass

Synthesis Example 6

Synthesis of Hybrid Crystalline Polyester Resin (6)

The same procedures were carried out as in Synthesis Example 1, except for using a raw material monomer of a polycondensation resin (crystalline polyester resin: CPEs2)

segment of the composition shown below in order to form a polycondensation resin (CPEs) segment, to obtain a hybrid crystalline polyester resin (6). The number average molecular weight (Mn) and melting point (Tm) of the hybrid crystalline polyester resin (6) are shown in Table 1 below.

Tetradecanedioic acid 294.6 parts by mass 1,4-Butanediol 97.7 parts by mass

Synthesis Example 7

Synthesis of Hybrid Crystalline Polyester Resin (7)

The same procedures were carried out as in Synthesis Example 1, except for using a raw material monomer of a polycondensation resin (crystalline polyester resin: CPEs3) segment of the composition shown below in order to form a polycondensation resin (CPEs) segment, to obtain a hybrid crystalline polyester resin (7). The number average molecular weight (Mn) and melting point (Tm) of the hybrid crystalline polyester resin (7) is shown in Table 1 below.

Dodecanedioic acid 311.7 parts by mass

Ethylene glycol 80 parts by mass

Synthesis Example 8

Synthesis of Hybrid Crystalline Polyester Resin (8)

The same procedures were carried out as in Synthesis Example 1, except for using a raw material monomer of a polycondensation resin (crystalline polyester resin: CPEs4) segment of the composition shown below in order to form a polycondensation resin (CPEs) segment, to obtain a hybrid crystalline polyester resin (8). The number average molecular weight (Mn) and melting point (Tm) of the hybrid crystalline polyester resin (8) are shown in Table 1 below.

Dodecanedioic acid 263.2 parts by mass 1,6-Hexanediol 128.6 parts by mass

Synthesis Example 9

Synthesis of Non-Hybrid Crystalline Polyester Resin (1)

A 5-L reaction vessel equipped with a stirrer, a temperature sensor, a cooling tube and a nitrogen introducing unit was charged with 281 parts by mass of tetradecanedioic acid and 206 parts by mass of 1,6-hexanediol, and the internal temperature of the vessel was raised to 190° C. over 1 hour with stirring this system. After confirming that the system was in the uniformly stirred state, $Ti(O\text{-}n\text{-}Bu)_4$ as a catalyst was added in an amount of 0.003% by mass relative to 100% by mass of the charged amount of tetradecanedioic acid. Thereafter, while distilling out the generated water, the internal temperature of the vessel was raised from 190° C. to 240° C. over 6 hours, and further the polymerization was carried out by continuing a dehydration condensation over 6 hours in the condition at a temperature of 240° C. to obtain a non-hybrid crystalline polyester resin (1). The number average molecular weight (Mn) and glass transition point (Tg) of the non-hybrid crystalline polyester resin (1) (CPEs5) are shown in Table 1 below.

[Preparation of Dispersion Liquid of Resin Particles and Colorant Particles]

Manufacturing Example 1

Preparation of Aqueous Dispersion Liquid (H1) of Hybrid Crystalline Polyester Resin Fine Particles 30 Parts by mass of the hybrid crystalline polyester resin (1) obtained in Synthesis Example 1 was melted, and transferred, in its melting state, to an emulsifying disperser "CAVITRON CD1010" (manufactured by EUROTEC, LTD.) at a transfer speed of 100 parts by mass per minute. Also, dilute aqueous ammonia diluted by 70 parts by mass of reagent aqueous ammonia with deionized water was adjusted so as to have a neutralization degree of 65% in an aqueous solvent tank, and the dilute aqueous ammonia was transferred to the emulsifying disperser at a transfer speed of 0.1 liter per minute while being heated to 100° C. with a heat exchanger, at the same time as the transfer of the hybrid crystalline polyester resin (1) in its melting state. Then, this emulsifying disperser was driven under the conditions of a rotation speed of the rotor of 60 Hz and a pressure of 5 $kg/cm^2$, to prepare an aqueous dispersion liquid (H1) of the hybrid crystalline polyester resin fine particles having 30% by mass of solid content.

Manufacturing Examples 2 to 8

Preparation of Aqueous Dispersion Liquids (H2) to (H8) of Hybrid Crystalline Polyester Resin Fine Particles The same procedures were carried out as in Manufacturing Example 1, except for respectively using the hybrid crystalline polyester resins (2) to (8) obtained in Synthesis Examples 2 to 8, in place of the hybrid crystalline polyester resin (1), to prepare each of aqueous dispersion liquids (H2) to (H8) of the hybrid crystalline polyester resin fine particles.

Manufacturing Example 9

Preparation of Aqueous Dispersion Liquid (N1) of Non-Hybrid Crystalline Polyester Resin Fine Particles The same procedures were carried out as in Manufacturing Example 1, except for using the non-hybrid crystalline polyester resin (1) obtained in Synthesis Example 9, in place of the hybrid crystalline polyester resin (1), to prepare an aqueous dispersion liquid (N1) of the non-hybrid crystalline polyester resin fine particles.

TABLE 1

| Aqueous dispersion liquid No. | Type of crystalline resin | Crystalline resin segment Kind | Raw material diol Carbon number | Raw material dicarboxylic acid Carbon number | Amorphous resin segment Kind | HB rate [%] | Number average molecular weight (Mn) | Melting point (Tm) [° C.] |
|---|---|---|---|---|---|---|---|---|
| H1 | Hybrid type (1) | CPEs 1 | 6 | 14 | StAc 1 | 10 | 5900 | 75.2 |
| H2 | Hybrid type (2) | CPEs 1 | 6 | 14 | StAc 1 | 5 | 6400 | 78 |
| H3 | Hybrid type (3) | CPEs 1 | 6 | 14 | StAc 1 | 20 | 4100 | 74 |
| H4 | Hybrid type (4) | CPEs 1 | 6 | 14 | StAc 1 | 30 | 4000 | 73 |
| H5 | Hybrid type (5) | CPEs 1 | 6 | 14 | StAc 2 | 10 | 7200 | 75 |
| H6 | Hybrid type (6) | CPEs 2 | 4 | 14 | StAc 1 | 10 | 4200 | 85 |
| H7 | Hybrid type (7) | CPEs 3 | 2 | 12 | StAc 1 | 10 | 7500 | 88 |
| H8 | Hybrid type (8) | CPEs 4 | 6 | 12 | StAc 1 | 10 | 3500 | 80 |
| N1 | Non-Hybrid type (1) | CPEs 5 | 6 | 14 | — | 0 | 5600 | 77*[1] |

*[1]Glass transition point (Tg)

Manufacturing Example 10

Preparation of Aqueous Dispersion Liquid (X1) of Vinyl Resin Fine Particles

<<First Step Polymerization>>

A 5-L reaction vessel equipped with a stirrer, a temperature sensor, a cooling tube and a nitrogen introducing unit was charged with 8 parts by mass of sodium dodecyl sulfate and 3000 parts by mass of deionized water, and the internal temperature of the vessel was raised to 80° C. with stirring at a stirring rate of 230 rpm under a nitrogen stream. After raising the temperature, a solution obtained by dissolving 10 parts by mass of potassium persulfate in 200 parts by mass of deionized water was added, and the temperature of the liquid was again raised to 80° C. Thereafter, a monomer composed of:

Styrene 480 parts by mass
n-Butyl acrylate 250 parts by mass
Methacrylic acid 68 parts by mass was added dropwise over 1 hour, then the mixture was heated and stirred over at 80° C. for 2 hours to perform polymerization to prepare a dispersion liquid (X1) of resin fine particles.

<<Second Step Polymerization>>

A 5-L reaction vessel equipped with a stirrer, a temperature sensor, a cooling tube and a nitrogen introducing unit was charged with a solution obtained by dissolving 7 parts by mass of sodium polyoxyethylene(2) dodecyl ether sulfate in 3000 parts by mass of deionized water, and the temperature was heated to 98° C. Then, 260 parts by mass of the dispersion liquid (X1) of resin fine particles and a solution obtained by dissolving a monomer mixed liquid (including a release agent) composed of:

Styrene 240 parts by mass
n-Butyl acrylate 111 parts by mass
Methacrylic acid 31 parts by mass
n-Octyl-3-mercaptopropionate 5.0 parts by mass
Release agent: Behenyl behenate (melting point of 73° C.) 83 parts by mass
Fischer Tropsh wax (melting point of 76° C.) 83 parts by mass at 75° C. were added thereto, and the mixture was mixed and dispersed for 1 hour by a mechanical disperser "CLEARMIX" (manufactured by M TECHNIQUE Co., Ltd.) having a circulatory channel, to prepare a dispersion liquid containing emulsified particles (oil droplet).

Subsequently, an initiator solution obtained by dissolving 6 parts by mass of potassium persulfate in 200 parts by mass of deionized water was added to this dispersion liquid, and this system was heated and stirred at 84° C. over 1 hour to perform polymerization to prepare a dispersion liquid (X2) of resin fine particles.

<<Third Step Polymerization>>

Furthermore, 400 parts by mass of deionized water was added to the dispersion liquid (X2) of resin fine particles, and well mixed, then a solution obtained by dissolving 11 parts by mass of potassium persulfate in 400 parts by mass of deionized water was added thereto, and a monomer mixed liquid composed of:

Styrene 420 parts by mass
n-Butyl acrylate 145 parts by mass
Acrylic acid 49 parts by mass
n-Octyl-3-mercaptopropionate 10 parts by mass was added dropwise under a temperature condition of 82° C., over 1 hour. After completion of dropwise addition, the mixture was heated and stirred over 2 hours to perform polymerization, and then, cooled to 28° C. to prepare an aqueous dispersion liquid (X1) of the resin fine particles composed on a vinyl resin (StAc resin).

The vinyl resin fine particles contained in the resulting aqueous dispersion liquid (X1) of the vinyl resin fine particles had a volume-based median diameter of 250 nm, a glass transition point (Tg) of 52° C., and a weight average molecular weight (Mw) of 32,000.

Manufacturing Examples 11 to 14

Preparation of Aqueous Dispersion Liquids (X2) to (X5) of Vinyl Resin Fine Particles According to Manufacturing Example 10, the same procedures were carried out as in Manufacturing Example 10, except for respectively changing the kind of the release agent from behenyl behenate/Fischer Tropsh wax to the kind shown in Table 2 below, to prepare each of aqueous dispersion liquids (X2) to (X5) of the vinyl resin fine particles. At that time, each of aqueous dispersion liquids was prepared without changing the total mass part of the release agent. Also, the vinyl resin fine particles each contained in the aqueous dispersion liquids (X2) to (X5) of vinyl resin fine particles had a volume-based median diameter within the range of 180 to 300 nm, a glass transition point (Tg) within the range of 45 to 55° C., and a weight average molecular weight (Mw) within the range of 25,000 to 40,000.

TABLE 2

| Vinyl resin fine particles | Release agent | | |
|---|---|---|---|
| Aqueous dispersion liquid No. | Kind | Mass ratio | Melting point [° C.] |
| X1 | Ester 1*2/ Hydrocarbon 1*3 | 50/50 | 75 |
| X2 | Ester 2*4 | 100 | (74)*1, 83 |
| X3 | Hydrocarbon 2*5 | 100 | (60~85)*1, 83 |
| X4 | Ester 1*2 | 100 | 73 |
| X5 | Hydrocarbon 1*3 | 100 | 76 |

*1The value in ( ) is not a main peak
*2Behenyl behenate
*3Fischer Tropsh wax
*4Pentaerythritol tetrabehenate
*5Microcrystalline wax

Manufacturing Example 15

Preparation of Aqueous Dispersion Liquid (AD-1) of Amorphous Polyester Resin Fine Particles In a reaction vessel equipped with a cooling tube, a stirrer and a nitrogen introducing tube was charged with 530 parts by mass of bisphenol-A propylene oxide 2 mol adduct, 145 parts by mass of terephthalic acid, 85 parts by mass of fumaric acid, and 3 parts by mass of titanium tetraisopropoxide as a polycondensation catalyst dividedly 15 times, and the mixture was reacted while distilling away water generated under a nitrogen stream at 200° C. for 12 hours. Subsequently, the reactant was reacted under a reduced pressure of 13.3 kPa (100 mmHg), and taken out at the time when the softening point reached 105° C. to obtain an amorphous polyester resin (a-1).

600 Parts by mass of this amorphous polyester resin (a-1) was pulverized by "Roundel Mill Type RM" (manufactured by TOKUJU Co., LTD), and mixed with 1800 parts by mass of a sodium lauryl sulfate solution with a concentration of 0.26% by mass prepared in advance. The mixture was subjected to ultrasonic dispersion at a V-LEVEL of 300 μA for 150 minutes using an ultrasonic homogenizer "US-150T" (manufactured by NIHONSEIKI KAISHA LTD.) while stirring, to prepare an aqueous dispersion liquid (AD-1) of the amorphous polyester resin fine particles in which the amorphous polyester resin (a-1) is dispersed.

Manufacturing Example 16

Preparation of Dispersion Liquid (WD-1) of Release Agent

A solution obtained by mixing 60 parts by weight of behenyl behenate as a release agent, 5 parts by mass of an ionic surfactant "NEOGEN RK" (manufactured by DKS Co. Ltd.), and 240 parts by mass of deionized water was heated to 95° C., and sufficiently dispersed using a homogenizer "ULTRA-TURRAX 150" (manufactured by IKA Corporation), then dispersed using a pressure-ejecting type Gaulin homogenizer, to prepare a dispersion liquid (WD-1)of release agent.

Manufacturing Example 17

Preparation of Dispersion Liquid (WD-2) of Release Agent

The same procedures were carried out as in Manufacturing Example 16, except for changing the release agent to Fischer Tropsh wax, to prepare a dispersion liquid (WD-2) of release agent.

Manufacturing Method 18

Preparation of Aqueous Dispersion Liquid (S1) of Amorphous Resin Fine Particles for Shell A raw material monomer of an addition polymerization resin (styrene-acrylic resin) segment of the composition shown below including a bireactive monomer, and a radical polymerization initiator, were added to a dropping funnel.

Styrene 80 parts by mass
n-Butyl acrylate 20 parts by mass
Acrylic acid 10 parts by mass
Polymerization initiator (di-t-butyl peroxide) 16 parts by mass Also, a raw material monomer of the following polycondensation resin (amorphous polyester resin) segment was charged to a four-neck flask equipped with a nitrogen introducing tube, a dewatering tube, a stirrer and a thermocouple, and dissolved by heating to 170° C.

Bisphenol-A propylene oxide 2 mol adduct 285.7 parts by mass
Terephthalic acid 66.9 parts by mass
Fumaric acid 47.4 parts by mass Subsequently, the raw material monomer of an addition polymerization resin was added dropwise over 90 minutes while stirring the content of the flask, and the mixture was aged for 60 minutes, then the unreacted raw material monomer of addition polymerization resin was removed under reduced pressure (8 kPa). The amount of monomer removed at that time was a very small amount relative to the amount of raw material monomer of the resin.

Thereafter, 0.4 parts by mass of $Ti(O\text{-}n\text{-}Bu)_4$ was added as an esterification catalyst, and the temperature was raised to 235° C., then the reaction was performed under normal pressure (101.3 kPa) for 5 hours and further under reduced pressure (8 kPa) for 1 hour.

Next, the reactant was cooled to 200° C., then reacted under reduced pressure (20 kPa) until reaching to a desired softening point. Subsequently, desolvation was carried out to obtain a resin for a shell (s1) as an amorphous resin. The resulting resin for a shell (s1) had a glass transition point (Tg) of 60° C., and a weight average molecular weight (Mw) of 66,700.

100 Parts by mass of the resulting resin for a shell (s1) was dissolved in 400 parts by mass of ethyl acetate (manufactured by KANTO CHEMICAL CO., INC.), and then mixed with 638 parts by mass of a sodium lauryl sulfate solution with a concentration of 0.26% by mass prepared in advance. The mixture was subjected to ultrasonic dispersion at a V-LEVEL of 300 μA for 30 minutes using an ultrasonic homogenizer "US-150T" (manufactured by NIHONSEIKI KAISHA LTD.) while stirring. Thereafter, in a heated state at 40° C., the ethyl acetate was completely removed under reduced pressure while stirring for 3 hours, using a diaphragm type vacuum pump "V-700" (manufactured by BUCHI), to prepare an aqueous dispersion liquid (S1) of amorphous resin fine particles for a shell having 13.5% by mass of solid content. The volume-based median diameter of the resin fine particles contained in the dispersion liquid (S1) was 160 nm.

Manufacturing Example 19

Preparation of Aqueous Dispersion Liquid (Cy1) of Colorant Fine Particles

90 Parts by mass of sodium lauryl sulfate was added to 1600 parts by mass of deionized water. While stirring this solution, 420 parts by mass of copper phthalocyanine (C.I. Pigment Blue 15:3) was gradually added, and subsequently dispersed using a stirrer "CLEARMIX" (manufactured by M TECHNIQUE Co., Ltd.) to prepare an aqueous dispersion liquid (Cy1) of colorant fine particles. The volume-based median diameter of the colorant fine particles contained in the dispersion liquid (Cy1) was 110 nm.

Example 1

Preparation of Toner (1)

(Mixed Liquid Preparation Step and Aggregation and Fusion Step)

A reaction vessel equipped with a stirrer, a temperature sensor and a cooling tube was charged with 195 parts by mass (in terms of solid content) of the aqueous dispersion liquid (X1) of the vinyl resin fine particles and 30 parts by mass (in terms of solid content) of the aqueous dispersion liquid (H1) of the hybrid crystalline polyester resin fine particles, and deionized water was further charged so as to have a total amount of 2000 parts by mass, then a 5 mol/liter aqueous sodium hydroxide solution was added thereto to adjust a pH of the solution to 10.

Thereafter, 40 parts by mass (in terms of solid content) of the aqueous dispersion liquid (Cy1) of colorant fine particles was charged, and subsequently, an aqueous magnesium chloride solution (aqueous solution in which 60 parts by mass of magnesium chloride was dissolved in 60 parts by mass of deionized water) was added thereto at 30° C. over 10 minutes while stirring. Subsequently, the temperature of this mixture was raised to 82° C. over 60 minutes, and the particle growth reaction was continued while maintaining at 82° C. In this state, the particle diameter of the aggregate particles was measured with "Coulter Multisizer 3" (manufactured by Beckman Coulter, Inc.), and at the time when the volume-based median diameter reached 6.0 μm, this mixture was cooled to 79° C., and 75 parts by mass (in terms of solid content) of the aqueous dispersion liquid (S1) of amorphous resin fine particles for a shell was charged over 30 minutes. At the time when the supernatant of the reaction liquid becomes transparent, the reaction liquid was cooled to 74° C., and an aqueous sodium chloride solution (aqueous solution prepared by dissolving 190 parts by mass of sodium chloride in 760 parts by mass of deionized water) was added to stop the particle growth. The mixture was heated and stirred at a state of 74° C. so that the fusion of the particles was allowed to proceed. At the time when the average circularity measured with a toner average circularity measurement apparatus "FPIA-2100" (manufactured by Sysmex Corporation) reached 0.945 (4,000 in HPF detection number), the mixture was cooled to 30° C. at a cooling rate of 10° C./min to obtain a dispersion liquid of the toner base particles (1X).

(Washing and Drying Step)

The dispersion liquid (1X) of the toner base particles produced in the aggregation and fusion step was subjected to solid-liquid separation. Subsequently, an operation in which the dehydrated toner cake was redispersed in deionized water, and then the solid and liquid separation was carried out, was repeated three times, then dried at 40° C. for 24 hours to obtain toner base particles (1X).

(External Additive Treatment Step)

The external additive treatment was conducted as described below to prepare toner (1). To 100 parts by mass of the resulting toner base particles (1X) were added 0.6 parts by mass of hydrophobic silica (number average primary particle diameter=12 nm, and hydrophobicity=68) and 1.0 part by mass of hydrophobic titanium oxide (number average primary particle diameter=20 nm, and hydrophobicity=63), and the mixture was mixed at a rotor blade circumferential speed of 35 mm/sec, at 32° C. for 20 minutes, by using a "Henschel mixer" (manufactured by Mitsui Miike Machinery Co., Ltd). Then, coarse particles were removed by using a sieve with a mesh opening of 45 μm.

Examples 2 to 8

Preparation of Toners (2) to (8)

The same procedures were carried out as in Example 1 described above, except for using each of the aqueous dispersion liquids (H2) to (H8) of the hybrid crystalline polyester resin fine particles, in place of the aqueous dispersion liquid (H1) of the hybrid crystalline polyester resin fine particles, to prepare each of toners (2) to (8).

Examples 9 to 10

Preparation of Toners (9) to (10)

The same procedures were carried out as in Example 1 described above, except for using each of the aqueous dispersion liquids (X2) and (X3) of the vinyl resin fine particles, in place of the aqueous dispersion liquid (X1) of the vinyl resin fine particles, according to the manufacturing method in Example 1, to prepare each of toners (9) to (10).

Example 11

Preparation of Toner (11)

(Mixed Liquid Preparation Step and Aggregation and Fusion Step)

A reaction vessel equipped with a stirrer, a temperature sensor and a cooling tube was charged with 195 parts by mass (in terms of solid content) of the aqueous dispersion liquid (X1) of the vinyl resin fine particles, 30 parts by mass (in terms of solid content) of the aqueous dispersion liquid (H1) of the hybrid crystalline polyester resin fine particles, and 2000 parts by mass of deionized water were charged, then a 5 mol/liter aqueous sodium hydroxide solution was added thereto to adjust a pH of the solution to 10.

Thereafter, 40 parts by mass (in terms of solid content) of the aqueous dispersion liquid (Cy1) of colorant fine particles was charged, and subsequently, an aqueous magnesium chloride solution (aqueous solution in which 60 parts by mass of magnesium chloride was dissolved in 60 parts by mass of deionized water) was added thereto at 30° C. over 10 minutes while stirring. Subsequently, the temperature of this system was raised to 82° C. over 60 minutes, and the particle growth reaction was continued while maintaining at 82° C. In this state, the particle diameter of the aggregate particles was measured with "Coulter Multisizer 3" (manufactured by Beckman Coulter, Inc.), and at the time when the volume-based median diameter reached 6.0 μm, the mixture was cooled to 74° C., and an aqueous sodium chloride solution (aqueous solution prepared by dissolving 190 parts by mass of sodium chloride in 760 parts by mass of deionized water) was added to stop the particle growth. The mixture was heated and stirred at a state of 74° C. so that the fusion of the particles was allowed to proceed. At the time when the average circularity of the particles measured with a toner average circularity measurement apparatus "FPIA-2100" (manufactured by Sysmex Corporation) reached 0.945 (4,000 in HPF detection number), the mixture was cooled to 30° C. at a cooling rate of 10° C./min to obtain toner base particles (11X).

(Washing and Drying Step)

The dispersion liquid (11X) of the toner base particles produced in the aggregation and fusion step was subjected to solid-liquid separation. Subsequently, an operation in which the dehydrated toner cake was redispersed in deionized water, and then the solid and liquid separation was carried out, was repeated three times, then dried at 40° C. for 24 hours to obtain toner particles (11X).

(External Additive Treatment Step)

The external additive treatment was conducted as described below to prepare toner (11). To 100 parts by mass of the resulting toner base particles (11X) were added 0.6 parts by mass of hydrophobic silica (number average primary particle diameter=12 nm, and hydrophobicity=68) and 1.0 part by mass of hydrophobic titanium oxide (number average primary particle diameter=20 nm, and hydrophobicity=63), and the mixture was mixed at a rotor blade circumferential speed of 35 mm/sec, at 32° C. for 20 minutes, by using a "Henschel mixer" (manufactured by Mitsui Miike Machinery Co., Ltd). Then, coarse particles were removed by using a sieve with a mesh opening of 45 μm.

Examples 12 to 13

Preparation of Toners (12) to (13)

The same procedures were carried out as in Example 11 described above, except for using each of the aqueous dispersion liquids (X2) to (X3) of the vinyl resin fine particles, in place of the aqueous dispersion liquid (X1) of the vinyl resin fine particles, to prepare each of toners (12) to (13).

Examples 14 to 15

Preparation of Toners (14) to (15)

The same procedures were carried out as in Example 11 described above, except for using each of the aqueous dispersion liquids (X2) to (X3) of the vinyl resin fine particles, and the aqueous dispersion liquid (H8) of the hybrid crystalline polyester resin fine particles, in place of the aqueous dispersion liquid (X1) of the vinyl resin fine particles and the aqueous dispersion liquid (H1) of the hybrid crystalline polyester resin fine particles, to prepare each of toners (14) to (15).

Comparative Example 1

Preparation of Toner (16)

The same procedures were carried out as in Example 1 described above, except for not using the aqueous dispersion liquid (H1) of the hybrid crystalline polyester resin fine particles, to prepare toner (16).

Comparative Examples 2 to 3

Preparation of Toners (17) to (18)

The same procedures were carried out as in Example 1 described above, except for using each of the aqueous dispersion liquids (X4) to (X5) of the vinyl resin fine particles, in place of the aqueous dispersion liquid (X1) of the vinyl resin fine particles, to prepare each of toners (17) to (18).

Comparative Example 4

Preparation of Toner (19)

The same procedures were carried out as in Example 1 described above, except for using the aqueous dispersion liquid (N1) of the non-hybrid crystalline polyester resin fine particles, in place of the aqueous dispersion liquid (H1) of the hybrid crystalline polyester resin fine particles, to prepare toner (19).

Comparative Example 5

Preparation of Toner (20)

The same procedures were carried out as in Example 1 described above, except for using the aqueous dispersion liquid (X2) of the vinyl resin fine particles and the aqueous dispersion liquid (N1) of the non-hybrid crystalline polyester resin fine particles, in place of the aqueous dispersion liquid (X1) of the vinyl resin fine particles and the aqueous dispersion liquid (H1) of the hybrid crystalline polyester resin fine particles, to prepare toner (20).

Comparative Example 6

Preparation of Toner (21)

The same procedures were carried out as in Example 1 described above, except for using the aqueous dispersion liquid (X3) of the vinyl resin fine particles and the aqueous dispersion liquid (N1) of the non-hybrid crystalline polyester resin fine particles, in place of the aqueous dispersion liquid (X1) of the vinyl resin fine particles and the aqueous dispersion liquid (H1) of the hybrid crystalline polyester resin fine particles, to prepare toner (21).

Comparative Example 7

Preparation of Toner (22)

The same procedures were carried out as in Example 1 described above, except for changing the aqueous dispersion liquid (X1) of the vinyl resin fine particles to 200 parts by mass of the aqueous dispersion liquid (AD-1) of the amorphous polyester resin fine particles, and further adding 27 parts by mass of the dispersion liquid (WD-1) of release agent and the 27 parts by mass of the dispersion liquid (WD-2) of release agent simultaneously with the amorphous polyester resin dispersion liquid (AD-1), to prepare toner (22).

The preparation conditions of each toner are shown in the following Table 3.

TABLE 3

| | | Amorphous resin fine particles | Crystalline resin fine particles | Type of | Release agent species | | |
|---|---|---|---|---|---|---|---|
| | | Aqueous dispersion liquid No. | Aqueous dispersion liquid No. | crystalline resin | Kind | | Mass ratio |
| Example 1 | Toner 1 | Vinyl resin (X1) | Hybrid resin (H1) | Hybrid type (1) | Ester 1 | Hydrocarbon 1 | 50/50 |
| Example 2 | Toner 2 | Vinyl resin (X1) | Hybrid resin (H2) | Hybrid type (2) | Ester 1 | Hydrocarbon 1 | 50/50 |
| Example 3 | Toner 3 | Vinyl resin (X1) | Hybrid resin (H3) | Hybrid type (3) | Ester 1 | Hydrocarbon 1 | 50/50 |
| Example 4 | Toner 4 | Vinyl resin (X1) | Hybrid resin (H4) | Hybrid type (4) | Ester 1 | Hydrocarbon 1 | 50/50 |
| Example 5 | Toner 5 | Vinyl resin (X1) | Hybrid resin (H5) | Hybrid type (5) | Ester 1 | Hydrocarbon 1 | 50/50 |
| Example 6 | Toner 6 | Vinyl resin (X1) | Hybrid resin (H6) | Hybrid type (6) | Ester 1 | Hydrocarbon 1 | 50/50 |
| Example 7 | Toner 7 | Vinyl resin (X1) | Hybrid resin (H7) | Hybrid type (7) | Ester 1 | Hydrocarbon 1 | 50/50 |
| Example 8 | Toner 8 | Vinyl resin (X1) | Hybrid resin (H8) | Hybrid type (8) | Ester 1 | Hydrocarbon 1 | 50/50 |
| Example 9 | Toner 9 | Vinyl resin (X2) | Hybrid resin (H1) | Hybrid type (1) | Ester 2 | — | 100 |
| Example 10 | Toner 10 | Vinyl resin (X3) | Hybrid resin (H1) | Hybrid type (1) | — | Hydrocarbon 2 | 100 |
| Example 11 | Toner 11 | Vinyl resin (X1) | Hybrid resin (H1) | Hybrid type (1) | Ester 1 | Hydrocarbon 1 | 50/50 |
| Example 12 | Toner 12 | Vinyl resin (X2) | Hybrid resin (H1) | Hybrid type (1) | Ester 2 | — | 100 |
| Example 13 | Toner 13 | Vinyl resin (X3) | Hybrid resin (H1) | Hybrid type (1) | — | Hydrocarbon 2 | 100 |
| Example 14 | Toner 14 | Vinyl resin (X2) | Hybrid resin (H8) | Hybrid type (8) | Ester 2 | — | 100 |
| Example 15 | Toner 15 | Vinyl resin (X3) | Hybrid resin (H8) | Hybrid type (8) | — | Hydrocarbon 2 | 100 |
| Comparative Example 1 | Toner 16 | Vinyl resin (X1) | — | — | Ester 1 | Hydrocarbon 1 | 50/50 |
| Comparative Example 2 | Toner 17 | Vinyl resin (X4) | Hybrid resin (H1) | Hybrid type (1) | Ester 1 | — | 100 |
| Comparative Example 3 | Toner 18 | Vinyl resin (X5) | Hybrid resin (H1) | Hybrid type (1) | — | Hydrocarbon 1 | 100 |
| Comparative Example 4 | Toner 19 | Vinyl resin (X1) | Non-hybrid resin (N1) | Non-hybrid type (1) | Ester 1 | Hydrocarbon 1 | 50/50 |
| Comparative Example 5 | Toner 20 | Vinyl resin (X2) | Non-hybrid resin (N1) | Non-hybrid type (1) | Ester 2 | — | 100 |
| Comparative Example 6 | Toner 21 | Vinyl resin (X3) | Non-hybrid resin (N1) | Non-hybrid type (1) | — | Hydrocarbon 2 | 100 |
| Comparative Example 7 | Toner 22 | Polyester resin (AD-1) | Hybrid resin (H1) | Hybrid type (1) | Ester 1 | Hydrocarbon 1 | 50/50 |

[Preparation of Developer]

A ferrite carrier coated with a silicone resin and having a volume-based median diameter of 60 μm was added and mixed to each of the toners (1) to (22) prepared in examples and comparative examples, so as to have a toner concentration of 6% by mass, to prepare each of developers (1) to (22).

[Evaluation of Toner and Developer]

(Observation of Cross Section of Toner Base Particles)

The cross section of toner base particles was observed by the following apparatus and conditions.

Observation Conditions

Device: transmission electron microscope "JEM-2000FX" (manufactured by JEOL, Ltd.)

Sample: section of toner base particles stained by ruthenium tetroxide ($RuO_4$) (thickness of section: 60 to 100 nm)

Acceleration voltage: 80 kV

Magnification: 50,000 times, bright-field image

Observation: Secondary electron image

Method for Preparing Section of Toner Base Particles

3 Parts by mass of the resulting toner (1) was added to 35 parts by mass of a 0.2% aqueous solution of polyoxyethylphenyl ether and dispersed, then the dispersion was treated with ultrasonic waves (manufactured by NIHONSEIKI KAISHA LTD., US-1200T) at 25° C. for 5 minutes so as to remove the external additive from the toner surface, to obtain toner base particles for TEM observation. Also for other toners, the external additive was removed in the same manner as described above to obtain toner base particles for TEM observation. In the present invention, the cross-sectional area of the particles after the above operation is an object to be evaluated.

10 mg of the toner base particles obtained above was stained once or twice under ruthenium tetroxide ($RuO_4$) steam staining conditions shown below, then dispersed in a photo-curable resin "D-800" (manufactured by JEOL, Ltd.), and photo-cured to form a block. Subsequently, using a microtome equipped with a diamond blade, an ultrathin section-like sample with a thickness of 60 to 100 nm was sliced from the block.

Ruthenium Tetroxide Staining Conditions

Staining was performed using a vacuum electron staining apparatus VSC1R1 (manufactured by Filgen, Inc). According to the apparatus procedures, a sublimation chamber containing ruthenium tetroxide was installed in the main body of the staining apparatus, and the ultrathin section prepared above was placed in the staining chamber. Thereafter, as to conditions of staining by ruthenium tetroxide, the staining was performed under the conditions of room temperature (24 to 25° C.) and concentration 3 (pressure of staining gas: 300 Pa), for 10 minutes.

Observation of Crystal Structure

After staining, the section was observed by a secondary electron image using a transmission electron microscope "JEM-2000FX" (manufactured by JEOL, Ltd.) within 24 hours.

As a result, both a structure body and a lamellar crystal structure that is not in contact with a release agent were observed in the toners (1) to (15) according to the examples. On the other hand, neither a structure body nor a lamellar crystal structure was not observed in the toner (16) according to the comparative example. Also, a structure body was not observed in the toner (17) according to the comparative example, and a lamellar crystal structure that is not in contact with a release agent was not observed in the toner (18), and a structure body was observed, but a crystalline resin that is not in contact with a release agent had fibrous crystal structure in toners (19) to (21). The "fibrous crystal structure" is as defined as above. Furthermore, a structure body was observed, but a lamellar crystal structure that is not in contact with a release agent was hardly formed in the toner (22). In the toner (22), the crystalline polyester resin was mainly observed as a structure body and a fibrous crystal structure.

Also, both the structure body and the lamellar crystal structure were confirmed in the cross section of 60% (60 particles) or more particles of 100 toner base particles, in the toners (1) to (15). Furthermore, a crystalline resin having a structure other than the structure body and the lamellar crystal structure was not observed, in the cross section of the toners (1) to (15).

On the other hand, the lamellar crystal structure was confirmed in the cross section of 60% (60 particles) or more particles of 100 toner base particles, in the toner (17). Also, the structure body was observed in the cross section of 60% (60 particles) or more particles of 100 toner base particles, in the toner (18). Furthermore, the structure body and the fibrous crystal structure were observed in the cross section of 60% (60 particles) or more particles of 100 toner base particles, in the toners (19) to (21). Also, the structure body, the fibrous crystal structure and the lamellar crystal structure (provided that the lamellar crystal structure is very less) were observed in the cross section of 60% (60 particles) or more particles of 100 toner base particles, in the toner (22).

Method for Measuring the Size (Average Domain Diameter, Average Long Diameter) of a Structure Body, a Lamellar Crystal Structure and a Fibrous Crystal Structure The size (domain diameter) of a structure body and a lamellar crystal structure in the cross section of the toner base particles were calculated as a horizontal Feret diameter (FERE H) of the structure body and the lamellar crystal structure, respectively. Specifically, the cross section on the toner base particles prepared as described above was photographed at 50,000 magnification at an acceleration voltage of 80 kV by a scanning electron microscope JEM-2000FX (manufactured by JEOL Ltd.), and picture images were scanned. Then, the horizontal Feret diameter (FERE H) of the structure body and each crystal structure was measured using an image processing/analysis equipment LUZEX AP (manufactured by Nireco Corporation). Also, the long diameter (long axis) and short diameter (short axis) of the fibrous structure were measured as well. An arithmetic average value for particles in which the structure body and the lamellar crystal structure were both observed, among the measured 100 toner base particles was calculated as the average domain diameter of the structure body and the lamellar crystal structure. Also, the arithmetic average value was each calculated for particles in which the lamellar crystal structure was observed in the toner (17) according to the comparative example, for particles in which the structure body was observed in the toner (18), and for particles in which the structure body and the fibrous crystal structure (also including particles in which the lamellar crystal structure is present in toner (22)) were observed in toners (19) to (22).

Ratio of a Cross-Sectional Area of a Structure Body and a Lamellar Crystal Structure The ratio (A/B) of the cross-sectional area was measured by the method same as the method for measuring the size of a structure body and a lamellar crystal structure described above. The ratio A of the cross-sectional area of the structure body to the cross-sectional area of the toner base particles and the ratio B of the cross-sectional area of the lamellar crystal structure to the cross-sectional area of the toner base particles were measured using "AREA" of an image processing/analysis equipment LUZEX AP (manufactured by Nireco Corporation). Each area was measured by an area surrounded by an external outline (for example, regarding the structure body, an area surrounded by a dot line in FIG. 3, and regarding the lamellar crystal structure, an area surrounding a lamellar crystal structure shown as symbol 4 by a solid line in FIG. 3 were measured). An arithmetic average value for those in which the structure body and the lamellar crystal structure were both observed, among the measured 100 toner base particles, was also calculated as a ratio of the cross-sectional area, in the toners (1) to (15). The arithmetic average value was each calculated for particles in which the lamellar crystal structure was observed in the toner (17) according to the comparative example, for particles in which the structure body was observed in the toner (18), and for particles in which the structure body and the fibrous crystal structure (also including particles in which the lamellar crystal structure is present in toner (22)) were observed in toners (19) to (22).

The observation results of the crystalline structure of each toner are shown in the following Table 4.

TABLE 4

| | | Amorphous resin dispersion liquid No. | Crystalline resin dispersion liquid No. | Toner structure | Size of each crystal structure: Structure body (domain diameter) [nm] | Lamellar crystal structure (domain diameter) [nm] | Fibrous structure (long diameter) [nm] | Cross-sectional area of crystal structure: Structure body A (%) | Lamellar structure B (%) | Total cross-sectional area A + B (%) | Cross-sectional area ratio A/B | Crystal structure |
|---|---|---|---|---|---|---|---|---|---|---|---|---|
| Example 1 | Toner 1 | (X1) | (H1) | Core shell | 1100 | 800 | — | 12 | 10 | 22 | 1.2 | Structure body + Lamellar |
| Example 2 | Toner 2 | (X1) | (H2) | Core shell | 1000 | 700 | — | 12 | 7 | 19 | 1.7 | Structure body + Lamellar |
| Example 3 | Toner 3 | (X1) | (H3) | Core shell | 1200 | 800 | — | 11 | 8 | 19 | 1.4 | Structure body + Lamellar |
| Example 4 | Toner 4 | (X1) | (H4) | Core shell | 1100 | 1100 | — | 11 | 7 | 18 | 1.6 | Structure body + Lamellar |
| Example 5 | Toner 5 | (X1) | (H5) | Core shell | 1000 | 900 | — | 12 | 8.5 | 20.5 | 1.4 | Structure body + Lamellar |
| Example 6 | Toner 6 | (X1) | (H6) | Core shell | 1000 | 850 | — | 12 | 7 | 19 | 1.7 | Structure body + Lamellar |
| Example 7 | Toner 7 | (X1) | (H7) | Core shell | 900 | 600 | — | 15 | 7 | 22 | 2.1 | Structure body + Lamellar |
| Example 8 | Toner 8 | (X1) | (H8) | Core shell | 1500 | 650 | — | 13 | 8 | 21 | 1.6 | Structure body + Lamellar |
| Example 9 | Toner 9 | (X2) | (H1) | Core shell | 800 | 1500 | — | 12 | 8 | 20 | 1.5 | Structure body + Lamellar |

TABLE 4-continued

| | | Amorphous resin dispersion liquid No. | Crystalline resin dispersion liquid No. | Toner structure | Size of each crystal structure: Structure body (domain diameter) [nm] | Lamellar crystal structure (domain diameter) [nm] | Fibrous structure (long diameter) [nm] | Cross-sectional area of crystal structure: Structure body A (%) | Lamellar structure B (%) | Total cross-sectional area A + B (%) | Cross-sectional area ratio A/B | Crystal structure |
|---|---|---|---|---|---|---|---|---|---|---|---|---|
| Example 10 | Toner 10 | (X3) | (H1) | Core shell | 1800 | 800 | — | 12 | 7 | 19 | 1.7 | Structure body + Lamellar |
| Example 11 | Toner 11 | (X1) | (H1) | Only core | 1000 | 800 | — | 12 | 9 | 21 | 1.3 | Structure body + Lamellar |
| Example 12 | Toner 12 | (X2) | (H1) | Only core | 500 | 1400 | — | 15 | 7 | 22 | 2.1 | Structure body + Lamellar |
| Example 13 | Toner 13 | (X3) | (H1) | Only core | 2100 | 700 | — | 12 | 7 | 19 | 1.7 | Structure body + Lamellar |
| Example 14 | Toner 14 | (X2) | (H8) | Only core | 2100 | 600 | — | 15 | 5 | 20 | 3.0 | Structure body + Lamellar |
| Example 15 | Toner 15 | (X3) | (H8) | Only core | 300 | 1200 | — | 5 | 10 | 15 | 0.5 | Structure body + Lamellar |
| Comparative Example 1 | Toner 16 | (X1) | — | Core shell | — | — | — | 0 | 0 | 0 | — | None |
| Comparative Example 2 | Toner 17 | (X4) | (H1) | Core shell | — | 850 | — | 0 | 8.5 | 8.5 | 0.0 | Lamellar |
| Comparative Example 3 | Toner 18 | (X5) | (H1) | Core shell | 2000 | — | — | 10 | 0 | 10 | — | Structure body |
| Comparative Example 4 | Toner 19 | (X1) | (N1) | Core shell | 1300 | — | 300 | 12 | 0 | 12 | — | Structure body + Fibrous |
| Comparative Example 5 | Toner 20 | (X2) | (N1) | Core shell | 700 | — | 400 | 10 | 0 | 10 | — | Structure body + Fibrous |
| Comparative Example 6 | Toner 21 | (X3) | (N1) | Core shell | 2200 | — | 400 | 13 | 0 | 13 | — | Structure body + Fibrous |
| Comparative Example 7 | Toner 22 | (AD-1) | (H1) | Core shell | 1500 | 600 | 300 | 15 | <1 | <16 | >15 | Structure body + Fibrous (+ Lamellar) |

(Evaluation of Physical Properties)

(1) Low-temperature Fixability

Using a commercially available full-color composite machine "bizhub (registered trademark) C754" (manufactured by Konica Minolta, Inc.) that was modified so that the surface temperature of a fixing upper belt and a fixing lower roller could be changed, as an image forming apparatus, mounting each of developers (1) to (22) as a developer, a solid image of a toner deposition amount of 11.3 g/m$^2$ was output on a recording medium "mondi Color Copy A4 90 g/m$^2$" (manufactured by mondi), in an environment of normal temperature and normal humidity (temperature of 20° C., relative humidity of 50% RH), under the following conditions. Specifically, a test of outputting was performed at a nip width of 11.2 mm, a fixing time of 34 msec, a fixing pressure of 133 kPa, and a fixing temperature of 100 to 200° C. The test was repeatedly performed while changing the fixing temperature by 5° C. until cold offset occurs. Moreover, the lowest surface temperature of the fixing upper belt at which cold offset does not occur was investigated, and low-temperature fixability was evaluated with this temperature as the fixing lower limit temperature. The result is shown in Table 5 below. Here, in each test, the "fixing temperature" refers to the surface temperature of the fixing upper belt. Also, the lower the fixing lower limit temperature, the more excellent in the low-temperature fixability it shows.

(2) High-speed Fixability

Using a commercially available full-color composite machine "bizhub (registered trademark) C754" (manufactured by Konica Minolta, Inc.) that was modified so that the surface temperature of a fixing upper belt and a fixing lower roller could be changed, as an image forming apparatus, mounting each of developers (1) to (22) as a developer, a solid image of a toner deposition amount of 11.3 g/m$^2$ was fixed on a recording medium "mondi Color Copy A4 90 g/m$^2$" (manufactured by mondi), in an environment of normal temperature and normal humidity (temperature of 20° C., relative humidity of 50% RH), under the following conditions. Specifically, setting the nip width to 11.2 mm, the fixing time to 34 msec, the fixing pressure to 133 kPa, and the initial process speed to 200 mm/sec, and while sequentially increasing the set speed by 25 mm/sec, unfixed images in each process speed were fixed (the upper limit of fixable linear velocity was set at 300 mm/sec). The set temperature was the fixing lower limit temperature of each toner in the evaluation of low-temperature fixability. The upper limit value of process speed in which low temperature offset was not confirmed, and the rank of fold was 2 or more when the obtained fixed image was folded using a folding machine, an air of 0.35 MPa was blown to the folded fixed image, and the condition of the fold was evaluated on the following five levels with reference to a limit sample, was defined as the fixable process speed (fixable linear velocity). In addition, the rank of the fold in the condition of the fixable linear velocity was evaluated on the following five levels. The result is shown in Table 5 below.

Here, the case where the fixable linear velocity was 300 mm/sec or more and the rank of the fold was 3 to 5 was defined as acceptable level.

—Rank of Fold—

Rank 5: no peeling at all on the fold;

Rank 4: peeling found along a part of the fold;

Rank 3: fine linear peeling found along the fold;

Rank 1: major peeling found on the image.

(3) Document Storability

Using a modified machine of "bizhub (registered trademark) C754" (manufactured by Konica Minolta, Inc.), unfixed images of a toner deposition amount of 10 g/m$^2$ was formed on a patch with an area of 3 cm×2 cm on a recording medium "POD gloss coated paper A4 128 g/m$^2$" (manufactured by Oji Paper Co., Ltd.), in an environment of normal temperature and normal humidity (20° C., 50% RH), and fixed at a nip width of 11.2 mm, a fixing time of 34 msec, a fixing pressure of 133 kPa, so as to have a glossiness of 60% by a 75° gloss meter. Thereafter, an image portion, and a non-image portion and an image portion were stacked so as to face each other, a weight was placed such that the weight corresponds to 80 g/cm$^2$ with respect to the stacked portion, and they were left in a thermohygrostat bath at 50° C. and a relative humidity of 50% RH for 7 days. The degree of image defects of the two stacked fixed images after being left was graded into five levels of "G1" to "G5" shown below. Here, G3 to G5 were defined as acceptable level. The result is shown in Table 5 below.

—Evaluation Criteria—

G1: Since the image portions adhere to each other, paper itself to which the images are fixed peels off, image defects are intense, and it can be obviously seen that the image is shifted to the non-image portion;

G2: Since the images adhere to each other, white spots being image defects are generated in some parts of the image portions;

G3: When the two stacked images are separated, although image roughness and gloss decrease are generated on the fixing surfaces thereof, there are almost no image defects, and even image defects present are allowable. The image is found to be slightly shifted to the non-image portion;

G4: When the two stacked images are separated, although the crack sound is made and the image is found to be slightly shifted to the non-image portion, there are no image defects without any problem at all; and G5: There are no image defects and image shift at all both in the image portions and non-image portion.

(4) Post-fixing Separability

Using a modified machine of "bizhub (registered trademark) C754" (manufactured by Konica Minolta, Inc.), a test was conducted as follows. Specifically, an overall solid image having a toner deposition amount of 4.0 g/m$^2$ was output repeatedly on a recording medium "Kinfuji 85 g/m$^2$ long grain" (manufactured by Oji Paper Co., Ltd.) having been left to stand overnight in an environment of normal temperature and normal humidity (temperature of 25° C., and relative humidity of 50% RH) to be conditioned in humidity, at a nip width of 11.2 mm, a fixing time of 34 msec, a fixing pressure of 133 kPa, and a fixing temperature of the upper belt of 160° C., with an end margin being set to 8 mm, until paper jam occurred while changing the end margin so as to be reduced in a manner of 7 mm, 6 mm, . . . by a unit of 1 mm, in the environment of normal temperature and normal humidity (temperature of 25° C., and relative humidity of 50% RH). The minimum end margin without occurrences of the paper jam was examined to thereby evaluate post-fixing separability. The smaller minimum end margin indicates more excellent post-fixing separability. The result is shown in Table 5 below. In the present invention, evaluation criteria of a and b were defined as acceptable.

—Evaluation Criteria— a: The end margin is 2 mm or less;

b: The end margin is more than 2 mm and 3 mm or less;

c: The end margin is more than 3 mm and 4 mm or less; and d: The end margin is more than 4 mm.

(5) Environmental Dependence of Charge Amount

A 20 ml glass vessel was charged with 19 g of a carrier and 1 g of a toner, and shaken 200 times per minute, at a shaking angle of 45 degree, with an arm of 50 cm, for 20 minutes, in the following two environments (environment of low temperature and low humidity, environment of high temperature and high humidity), then the charge amount was measured by a blow-off method.

Environment of low temperature and low humidity: set at 10° C., 10% RH atmosphere Environment of high temperature and high humidity: set at 30° C., 85% RH atmosphere The rank was evaluated as follows, depending on the difference between the charge amount in the environment of low temperature and low humidity and the charge amount in the environment of high temperature and high humidity. The result is shown in Table 5 below. Herein, "excellent" and "good" are defined as acceptable.

—Evaluation Criteria—

Excellent: less than 5 μC/g;

Good: 5 μC/g or more, and less than 8 μC/g;

Practicable: 8 μC/g or more, and less than 12 μC/g; and

Impracticable: 12 μC/g or more.

TABLE 5

| | | Low-temperature fixability | High-speed fixability | | | | Charge amount Environmental |
|---|---|---|---|---|---|---|---|
| | | Fixing lower limit temperature [° C.] | Fixable linear velocity (mm/sec) | Rank of fold | Document storability | Post-fixing separability | dependence (Environmental difference) [μC/g] |
| Example 1 | Toner 1 | 150 | 300 | 5 | 5 | a | 7 |
| Example 2 | Toner 2 | 150 | 300 | 4 | 3 | b | 6 |
| Example 3 | Toner 3 | 150 | 300 | 4 | 4 | a | 6 |
| Example 4 | Toner 4 | 150 | 300 | 4 | 4 | b | 6 |
| Example 5 | Toner 5 | 150 | 300 | 4 | 4 | a | 6 |
| Example 6 | Toner 6 | 150 | 300 | 4 | 3 | b | 6.5 |
| Example 7 | Toner 7 | 150 | 300 | 4 | 3 | b | 6 |
| Example 8 | Toner 8 | 150 | 300 | 4 | 4 | b | 6.5 |
| Example 9 | Toner 9 | 155 | 300 | 4 | 4 | b | 6 |
| Example 10 | Toner 10 | 155 | 300 | 4 | 3 | a | 6 |
| Example 11 | Toner 11 | 150 | 300 | 4 | 5 | a | 6 |
| Example 12 | Toner 12 | 150 | 300 | 4 | 3 | b | 6.5 |
| Example 13 | Toner 13 | 150 | 300 | 4 | 4 | b | 6 |
| Example 14 | Toner 14 | 150 | 300 | 3 | 3 | b | 5.5 |
| Example 15 | Toner 15 | 150 | 300 | 4 | 4 | a | 7 |
| Comparative Example 1 | Toner 16 | 180 | 225 | 2 | 1 | c | 3.5 |
| Comparative Example 2 | Toner 17 | 150 | 300 | 4 | 2 | b | 7 |
| Comparative Example 3 | Toner 18 | 150 | 275 | 3 | 2 | c | 6 |
| Comparative Example 4 | Toner 19 | 150 | 275 | 3 | 3 | c | 6 |
| Comparative Example 5 | Toner 20 | 155 | 275 | 3 | 2 | c | 6 |
| Comparative Example 6 | Toner 21 | 155 | 275 | 3 | 3 | c | 6 |
| Comparative Example 7 | Toner 22 | 150 | 300 | 3 | 3 | c | 13.5 |

As described above, the toners (1) to (15) showed characteristics of having excellent high-speed fixability, document storability and post-fixing separability, and further, small environmental dependence of chargeability while having low-temperature fixability.

On the other hand, it was shown that the toners (16) to (21) not containing either (or both) of the structure body according to the present invention, and the lamellar crystal structure that is not in contact with the release agent, lack practicality in any of the evaluation items described above, and are not a toner satisfying all of the low-temperature fixability, high-speed fixability, document storability and post-fixing separability, in a good balance. In addition, the toner (22) according to the comparative example does not contain a vinyl resin as an amorphous resin, and it was shown that such toner has particularly worse environmental dependence of chargeability.

What is claimed is:

1. A toner for electrostatic charge image development containing toner base particles containing a binder resin containing a vinyl resin as a main component and a crystalline resin, and a release agent, comprising a structure body in which the crystalline resin is in contact with the release agent, and the crystalline resin having a lamellar crystal structure that is not in contact with the release agent, in a cross section. of the toner base particles, wherein the crystalline resin comprises a hybrid crystalline polyester resin in which a crystalline polyester resin segment and a vinyl resin segment are chemically bonded, an amount of the release agent is 1 to 20% by mass relative to a total amount of the binder resin, an amount of the hybrid crystalline polyester resin is 3 to 50% by mass relative to the total amount of the binder resin, and an amount of the vinyl resin is 50 to 95% by mass relative to the total amount of the binder resin.

2. The toner for electrostatic charge image development according to claim 1, wherein an average domain diameter of the structure body is 200 to 2500 nm.

3. The toner for electrostatic charge image development according to claim 1, wherein an average domain. diameter of the lamellar crystal structure is 100 to 2000 nm.

4. The toner for electrostatic charge image development according to claim 1, wherein. a ratio of a total cross-sectional area of the structure body and the lamellar crystal structure to a cross-sectional area of the toner base particles is 1 to 50%.

5. The toner for electrostatic charge image development according to claim 1, wherein a ratio A of a cross-sectional area of the structure body to a cross-sectional area of the toner base particles and a ratio B of a cross-sectional area of the lamellar crystal structure to the cross-sectional area of the toner base particles satisfy the relation of the following equation (1):

$$0.1 \leq A/B \leq 5 \quad (1).$$

6. The toner for electrostatic charge image development according to claim 1, wherein a ratio A of a cross-sectional area of the structure body to a cross-sectional area of the toner base particles is 1 to 25%.

7. The toner for electrostatic charge image development according to claim 1, wherein a ratio B of a cross-sectional area of the lamellar crystal structure to a cross-sectional area of the toner base particles is 1to 25%.

8. The toner for electrostatic charge image development according to claim 1, wherein an amount of the vinyl resin segment is 5 to 30% by mass relative to a total amount of the hybrid crystalline polyester resin.

9. The toner for electrostatic charge image development according to claim 1, wherein the toner base particles have a core particle and a shell part covering the surface of the core particle.

* * * * *